US012577021B2

(12) United States Patent
Sain et al.

(10) Patent No.: US 12,577,021 B2
(45) Date of Patent: Mar. 17, 2026

(54) SEALING MEMBER FOR PACKAGING

(71) Applicant: NICOVENTURES TRADING LIMITED, London (GB)

(72) Inventors: Matthew D. Sain, Mocksville, NC (US); Wesley Steven Jones, Lexington, NC (US); Pankaj C. Patel, Clemmons, NC (US)

(73) Assignee: NICOVENTURES TRADING LIMITED, London (GB)

( * ) Notice: Subject to any disclaimer, the term of this patent is extended or adjusted under 35 U.S.C. 154(b) by 104 days.

(21) Appl. No.: 17/959,061

(22) Filed: Oct. 3, 2022

(65) Prior Publication Data

US 2024/0109697 A1 Apr. 4, 2024

(51) Int. Cl.

| | |
|---|---|
| ***B65D 51/16*** | (2006.01) |
| ***A24F 23/00*** | (2006.01) |
| ***B65D 43/02*** | (2006.01) |
| ***B65D 53/00*** | (2006.01) |

(52) U.S. Cl.

CPC ..... *B65D 51/1627* (2013.01); *A24F 23/00* (2013.01); *B65D 43/0222* (2013.01); *B65D 53/00* (2013.01); *B65D 2543/00092* (2013.01); *B65D 2543/00537* (2013.01)

(58) Field of Classification Search

CPC ..... B65D 2543/00092; A24F 23/00; A24F 25/02

USPC ..... 206/242, 247, 245

See application file for complete search history.

(56) References Cited

U.S. PATENT DOCUMENTS

| | | | | | |
|---|---|---|---|---|---|
| 420,580 | A * | 2/1890 | Miles | B65D 85/12 | 206/247 |
| 548,806 | A * | 10/1895 | La Baw | A24F 27/06 | 206/265 |
| 641,757 | A * | 1/1900 | Blaskower | B65D 85/12 | 217/17 |
| 1,837,784 | A * | 12/1931 | Luckett | B65D 7/10 | 206/265 |
| 1,969,384 | A * | 8/1934 | Perine | B65D 85/1027 | 229/87.13 |
| 2,185,604 | A * | 1/1940 | Moore | B65D 43/169 | 206/256 |

(Continued)

FOREIGN PATENT DOCUMENTS

| | | | | |
|---|---|---|---|---|
| GB | 2493836 | A * | 2/2013 | B65D 55/0818 |
| SE | 541144 | C2 | 12/2017 | |
| WO | 2010/034583 | A1 | 4/2010 | |

*Primary Examiner* — Steven A. Reynolds
*Assistant Examiner* — Prince Pal
(74) *Attorney, Agent, or Firm* — WOMBLE BOND DICKINSON (US) LLP

(57) ABSTRACT

The present disclosure provides components of packaging that is adapted for storing a product including a container having a body and a cover. The body and the cover define an internal storage compartment adapted for storage of a product. The body is configured to interact with the cover so as to form a joint when engaged. A sealing member is configured to substantially cover the joint, wherein the material of the sealing member is continuous and uninterrupted, thus limiting moisture loss from a product within the internal storage compartment. The sealing member is further configured to tear in a direction that is substantially parallel to the joint of the container.

9 Claims, 13 Drawing Sheets

(56) References Cited

U.S. PATENT DOCUMENTS 2,261,423 A * 11/1941 Toulouse ..... B65B 19/26 206/443
2,671,707 A * 3/1954 Lombard ..... A24F 25/02 206/242
3,112,028 A * 11/1963 Kinsell ..... A45F 5/02 206/265
3,396,899 A * 8/1968 Vincent ..... B65D 51/20 229/125.05
3,446,391 A * 5/1969 Yates, Jr. ..... B65D 43/0212 220/792
4,807,745 A * 2/1989 Langley ..... B65D 85/1018 206/245
5,752,599 A * 5/1998 Veltman ..... B60R 7/00 248/152
6,802,422 B2 * 10/2004 Kalvelage ..... B65D 75/367 206/538
7,537,113 B2 * 5/2009 Tambo ..... B65D 5/6691 206/268
7,744,131 B2 * 6/2010 Urbanek ..... G09F 3/0288 283/105
7,798,319 B1 * 9/2010 Bried ..... B65D 51/16 220/366.1
7,878,324 B2 * 2/2011 Bellamah ..... A24F 23/00 220/4.27
8,215,482 B2 * 7/2012 Cronin ..... B65D 25/02 206/265
8,469,187 B2 * 6/2013 Wattenbarger ..... A45C 13/008 206/242
8,550,093 B2 * 10/2013 Saint-Girons ..... B65D 77/06 53/399
8,567,597 B2 * 10/2013 Gibson ..... B65D 51/28 206/242
9,497,992 B2 * 11/2016 Evans ..... B65D 55/06
9,795,165 B2 * 10/2017 Bried ..... B65D 51/16
10,548,347 B2 * 2/2020 Playford ..... B65D 55/0818
10,676,262 B2 * 6/2020 Beardsall ..... G09F 3/0341
11,147,309 B2 * 10/2021 Patel ..... A24F 23/00
11,622,575 B2 * 4/2023 Patel ..... A24F 23/00 206/265
11,648,177 B2 * 5/2023 Bois ..... B65D 81/266 206/204
11,737,492 B1 * 8/2023 Coates ..... A24F 23/00 206/265
11,812,781 B1 * 11/2023 Siann ..... A24F 25/02
D1,011,886 S * 1/2024 Patel ..... D9/504
D1,014,254 S * 2/2024 Patel ..... D9/504
2003/0047469 A1 * 3/2003 Draghetti ..... B65C 1/025 206/245
2004/0256253 A1 * 12/2004 Henson ..... A24F 15/12 206/242
2006/0278543 A1 * 12/2006 Pham ..... B65D 85/1081 206/242
2007/0023301 A1 * 2/2007 Pham ..... B65D 85/1081 206/242
2007/0130811 A1 * 6/2007 Shevelev ..... G09F 3/10 40/638
2007/0251913 A1 * 11/2007 Mengeu ..... B65D 51/1644 215/261
2008/0202956 A1 * 8/2008 Welk ..... A24F 23/00 206/265
2009/0014343 A1 * 1/2009 Clark ..... A24F 23/00 206/265
2009/0230003 A1 * 9/2009 Thiellier ..... A24F 23/00 206/265
2010/0012534 A1 * 1/2010 Hoffman ..... B65D 15/18 206/265
2010/0018882 A1 * 1/2010 St. Charles ..... B65D 51/28 206/242
2010/0018883 A1 * 1/2010 Patel ..... B65D 51/28 206/256
2010/0176130 A1 * 7/2010 Kim ..... B65D 43/0214 220/254.1
2010/0206320 A1 * 8/2010 Hodgson ..... A24F 23/00 206/265
2010/0206754 A1 * 8/2010 Roy ..... A24F 15/20 206/268
2010/0243488 A1 * 9/2010 Gibson ..... A24F 23/00 206/265
2011/0290682 A1 * 12/2011 Gibson ..... B65D 77/20 206/265
2011/0303566 A1 * 12/2011 Gibson ..... B65D 43/0222 206/265
2012/0193265 A1 * 8/2012 Patel ..... A24F 23/00 206/524.6
2012/0247986 A1 * 10/2012 Wattenbarger ..... A45C 13/002 206/265
2013/0256163 A1 * 10/2013 Cottle ..... A24F 15/00 206/265
2013/0292279 A1 * 11/2013 Bengtsson ..... B65D 85/10 206/245
2014/0069829 A1 * 3/2014 Evans ..... A24F 23/02 206/265
2014/0197054 A1 * 7/2014 Pipes ..... A24F 23/00 206/265
2014/0262903 A1 * 9/2014 Mitten ..... B65D 55/0818 206/459.5
2015/0041345 A1 * 2/2015 Kerkar ..... A24D 1/02 206/242
2015/0136618 A1 * 5/2015 Patel ..... B65D 81/22 206/0.5
2015/0375923 A1 * 12/2015 Pilzecker ..... B65D 65/14 206/245
2016/0106149 A1 * 4/2016 Potter ..... B65D 81/26 206/265
2016/0106150 A1 * 4/2016 Garcia ..... A24F 23/00 206/265
2017/0100308 A1 * 4/2017 Lampe ..... A61J 19/00
2017/0369223 A1 * 12/2017 Beardsall ..... B32B 15/08
2018/0134463 A1 * 5/2018 Sebben ..... B65D 51/249
2019/0261681 A1 * 8/2019 Playford ..... B65D 77/32
2021/0002061 A1 * 1/2021 Bois ..... B65D 47/08
2021/0300640 A1 * 9/2021 Ludewig ..... B65D 51/24
2022/0071280 A1 * 3/2022 Patel ..... B65D 81/22
2022/0087217 A1 * 3/2022 Pierce ..... B65D 85/72
2022/0104543 A1 * 4/2022 Patel ..... B65D 50/045
2022/0135293 A1 * 5/2022 Hession ..... B65D 41/16 206/265
2023/0013978 A1 * 1/2023 Patel ..... B65D 43/0212
2023/0329334 A1 * 10/2023 Patel ..... B65D 41/185
2024/0002121 A1 * 1/2024 Lidstrand ..... B65D 51/28
2024/0109697 A1 * 4/2024 Sain ..... B65D 51/1627

* cited by examiner

SEALING MEMBER FOR PACKAGING

FIELD OF THE DISCLOSURE

The present disclosure relates to containers, components thereof, and methods of use thereof. More particularly, the disclosure relates to sealing members for packaging, such as containers useful for containing oral products, such as tobacco products.

BACKGROUND OF THE DISCLOSURE

Various types of containers for dispensing solid objects, particularly solid products intended for human consumption, are known in the art. Such containers are often characterized by a hand-held size that can be easily stored and transported. Example consumable products that are often packaged in such containers include a wide variety of consumer products, including oral products.

There are many categories of products intended for oral use and enjoyment. For example, traditional combustible products such as cigarettes are widely known. An additional example includes oral products containing nicotine, which is known to have both stimulant and anxiolytic properties, have also been available for many years. Conventional formats for so-called "smokeless" tobacco products include moist snuff, snus, and chewing tobacco, which are typically formed almost entirely of particulate, granular, or shredded tobacco, and which are either portioned by the user or presented to the user in individual portions, such as in single-use pouches or sachets. See for example, the types of smokeless tobacco formulations, ingredients, and processing methodologies set forth in U.S. Pat. No. 6,668,839 to Williams; U.S. Pat. No. 6,834,654 to Williams; U.S. Pat. No. 6,953,040 to Atchley et al.; U.S. Pat. No. 7,032,601 to Atchley et al.; and U.S. Pat. No. 7,694,686 to Atchley et al.; U.S. Pat. No. 7,810,507 to Dube et al.; U.S. Pat. No. 7,819,124 to Strickland et al.; U.S. Pat. No. 7,861,728 to Holton, Jr. et al.; U.S. Pat. No. 7,901,512 to Quinter et al.; U.S. Pat. No. 8,627,828 to Strickland et al.; U.S. Pat. No. 11,246,334 to Atchley, each of which is incorporated herein by reference. Representative smokeless tobacco products that have been marketed include those referred to as CAMEL Orbs, CAMEL Strips and CAMEL Sticks by R. J. Reynolds Tobacco Company; GRIZZLY moist tobacco, KODIAK moist tobacco, LEVI GARRETT loose tobacco and TAYLOR'S PRIDE loose tobacco by American Snuff Company, LLC; KAYAK moist snuff and CHATTANOOGA CHEW chewing tobacco by Swisher International, Inc.; REDMAN chewing tobacco by Pinkerton Tobacco Co. LP; COPENHAGEN moist tobacco and RED SEAL long cut by U.S. Smokeless Tobacco Company; and Taboka by Philip Morris USA. Representative types of snuff products, commonly referred to as "snus," which may comprise pasteurized or heat treated tobacco products, are manufactured in Europe, particularly in Sweden, by or through companies such as Swedish Match AB, Fiedler & Lundgren AB, Gustavus AB, Skandinavisk Tobakskompagni A/S and Rocker Production AB. Snus products available in the U.S.A. have been marketed under the trade names such as CAMEL Snus Frost, CAMEL Snus Original and CAMEL Snus Spice by R. J. Reynolds Tobacco Company. Snus products, such as CAMEL Snus Original, are commonly supplied in small teabag-like pouches. The pouches are typically a nonwoven fleece material, and contain about 0.4 to 1.5 grams of pasteurized tobacco. These products typically remain in a user's mouth for about 10-30 minutes.

Unlike certain other smokeless tobacco products, snus products typically do not require expectoration by the user. Other pouch types of smokeless tobacco products include those marketed as COPENHAGEN Pouches, SKOAL Bandits, SKOAL Pouches, REVEL Mint Tobacco Packs by U.S. Smokeless Tobacco Company; and MARLBORO Snus by Philip Morris USA.

In addition, traditional tobacco materials and non-tobacco materials have been combined with other ingredients to form product formats distinct from traditional smokeless products, with example formats including lozenges, pastilles, gels, and the like. See, for example, the types of products described in US Patent App. Pub. Nos. 2008/0196730 to Engstrom et al.; 2008/0305216 to Crawford et al.; 2009/0293889 to Kumar et al.; 2010/0291245 to Gao et al; 2011/0139164 to Mua et al.; 2012/0037175 to Cantrell et al.; 2012/0055494 to Hunt et al.; 2012/0138073 to Cantrell et al.; 2012/0138074 to Cantrell et al.; 2013/0074855 to Holton, Jr.; 2013/0074856 to Holton, Jr.; 2013/0152953 to Mua et al.; 2013/0274296 to Jackson et al.; 2015/0068545 to Moldoveanu et al.; 2015/0101627 to Marshall et al.; and 2015/0230515 to Lampe et al., each of which is incorporated herein by reference.

Certain containers are manufactured and designed the protection of the product from environmental effects, particularly those effects that may degrade the product stored in the container. For example, in humid environments, moisture may invade the storage space housing the product, thereby damaging the product or otherwise rendering the product unusable. In other instances, venting within the enclosure formed by the container may be needed for properly storing a product.

BRIEF SUMMARY OF THE DISCLOSURE

The present disclosure provides sealing members useful with packaging, such as a container. In certain embodiments, the sealing member can be adhered or otherwise attached to an exterior surface of the container that can prevent tampering with the product before purchase, and the sealing member can include a pull tab at an end thereof that can facilitate removal of at least a portion of the sealing member for opening of the container by a user. In some embodiments, removal of the sealing member can be achieved even in the absence of perforations. In some embodiments, the container with which the sealing member is used can be provided in a convenient handheld size. The type and form of the product to be stored within the container can vary. In certain embodiments, the container can be used to store oral products.

In one or more embodiments, the present disclosure can provide a packaged product. For example, the packaged product can comprise: a container comprising a container body and a container cover arranged to engage the container body so as to define a joint extending around a periphery of the container; a product positioned within the container, the product being a solid and having a defined moisture content; and a sealing member surrounding the periphery of the container in the location of the joint, the sealing member being a tearable tape that is at least partially adhered to both the container body and the container cover; wherein the sealing member is effective to limit moisture transfer through the joint as measured by a change in the defined moisture content of the product positioned within the container of less than 2 mg/day. In further embodiments, the packaged product can be defined in relation to one or more of the following statements, which statements can be combined in any number and/or order.

The sealing member can extend from a first end to a second end, the first end defining a pull tab.

The sealing member can have a sufficient length so that the first end overlaps the second end when surrounding the periphery of the container.

The first end to the second end can be at least partially adhered to both the container body and the container cover.

At least a portion of the pull tab that is defined at the first end may not be adhered to the second end segment.

The first end of the sealing member can have a terminal edge, and a portion of the pull tab can extend a distance beyond the terminal edge.

The tearable tape can be continuous and uninterrupted across a width thereof and a length thereof.

At least a portion of the second end segment of the tearable tape can be fixedly adhered to the container.

The tearable tape can comprise a continuous adhesive coating.

The portion of the pull tab that extends a distance beyond the terminal edge can have a curvilinear edge.

The change in the defined moisture content of the product positioned within the container can be less than 1.5 mg/day.

In one or more embodiments, the present disclosure can relate methods of reducing moisture transfer. For example, the method can comprise: providing packaging comprising a body and a cover arranged to engage the body so as to define a joint extending around a periphery of the packaging; positioning a product within the packaging, the product being a solid and having a defined moisture contend; and adhering a sealing member at the joint, wherein the sealing member effective to limit moisture transfer through the joint as measured by a change in the defined moisture content of the product positioned within the package of less than 2 mg/day. In further embodiments, the methods can be defined in relation to one or more of the following statements, which statements can be combined in any number and/or order.

The sealing member can extend from a first end to a second end, the first end defining a pull tab.

The sealing member can have a sufficient length so that the first end overlaps the second end when surrounding the periphery of the container.

At least a portion of the pull tab that is defined at the first end may not be adhered to the second end segment.

The first end of the sealing member can have a terminal edge, and a portion of the pull tab can extend a distance beyond the terminal edge.

The tearable tape can be continuous and uninterrupted across a width thereof.

At least a portion of the second end segment of the tearable tape can be fixedly adhered to the container.

The portion of the pull tab that extends a distance beyond the terminal edge can have a curvilinear edge.

The change in the defined moisture content of the product positioned within the container can be than 1.5 mg/day.

The tearable tape can be perforated parallel to the joint and along the length of the tearable.

The tearable tape can be adhered to the body of the container and the cover of the container between the perforation of the tearable tape and the joint.

The invention includes, without limitation, the following embodiments.

Embodiment 1: A packaged product, comprising: a container comprising a container body and a container cover arranged to engage the container body so as to define a joint extending around a periphery of the container; a product positioned within the container, the product being a solid and having a defined moisture content; and a sealing member surrounding the periphery of the container in the location of the joint, the sealing member being a tearable tape that is at least partially adhered to both the container body and the container cover; wherein the sealing member is effective to limit moisture transfer through the joint as measured by a change in the defined moisture content of the product positioned within the container of less than 2 mg/day.

Embodiment 2: The packaged product of embodiment 1, wherein the sealing member extends from a first end to a second end, the first end defining a pull tab.

Embodiment 3: The packaged product of embodiment 2, wherein the sealing member has a sufficient length so that the first end overlaps the second end when surrounding the periphery of the container.

Embodiment 4: The packaged product of embodiment 2, wherein the first end to the second end is at least partially adhered to both the container body and the container cover.

Embodiment 5: The packaged product of embodiment 4, wherein at least a portion of the pull tab that is defined at the first end is not adhered to the second end segment.

Embodiment 6: The packaged product of embodiment 2, wherein the first end has a terminal edge, and wherein a portion of the pull tab extends a distance beyond the terminal edge.

Embodiment 7: The packaged product of embodiment 1, wherein the tearable tape is continuous and uninterrupted across a width thereof and a length thereof.

Embodiment 8: The packaged product of embodiment 4, wherein at least a portion of the second end segment of the tearable tape is fixedly adhered to the container.

Embodiment 9: The packaged product of embodiment 8, wherein the tearable tape comprises a continuous adhesive coating.

Embodiment 10: The packaged product of embodiment 6, wherein the portion of the pull tab that extends a distance beyond the terminal edge has a curvilinear edge.

Embodiment 11: The packaged product of embodiment 1, wherein the change in the defined moisture content of the product positioned within the container of less than 1.5 mg/day Embodiment 12: A method of reducing moisture transfer comprising: providing packaging comprising a body and a cover arranged to engage the body so as to define a joint extending around a periphery of the packaging; positioning a product within the packaging, the product being a solid and having a defined moisture contend; and adhering a sealing member at the joint, wherein the sealing member effective to limit moisture transfer through the joint as measured by a change in the defined moisture content of the product positioned within the package of less than 2 mg/day.

Embodiment 13: The method of embodiment 12, wherein the sealing member extends from a first end to a second end, the first end defining a pull tab.

Embodiment 14: The method of embodiment 13, wherein the sealing member has a sufficient length so that the first end overlaps the second end when surrounding the periphery of the container.

Embodiment 15: The method of embodiment 13, wherein at least a portion of the pull tab that is defined at the first end is not adhered to the second end segment.

Embodiment 16: The method of embodiment 13, wherein the first end has a terminal edge, and wherein a portion of the pull tab extends a distance beyond the terminal edge.

Embodiment 17: The method of embodiment 12, wherein the tearable tape is continuous and uninterrupted across a width thereof.

Embodiment 18: The method of embodiment 15, wherein at least a portion of the second end segment of the tearable tape is fixedly adhered to the container.

Embodiment 19: The method of embodiment 18, wherein the portion of the pull tab that extends a distance beyond the terminal edge has a curvilinear edge.

Embodiment 20: The method of embodiment 12, wherein the change in the defined moisture content of the product positioned within the container of less than 1.5 mg/day.

Embodiment 21: The packaged product of embodiment 1, wherein the tearable tape is perforated parallel to the joint and along the length of the tearable.

Embodiment 22: The packaged product of embodiment 21, wherein the tearable tape is adhered to the body of the container and the cover of the container between the perforation of the tearable tape and the joint.

These and other features, aspects, and advantages of the disclosure will be apparent from a reading of the following detailed description together with the accompanying drawings, which are briefly described below. The invention includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed invention, in any of its various aspects and embodiments, should be viewed as intended to be combinable unless the context clearly dictates otherwise.

BRIEF DESCRIPTION OF THE DRAWINGS

Figure 1:
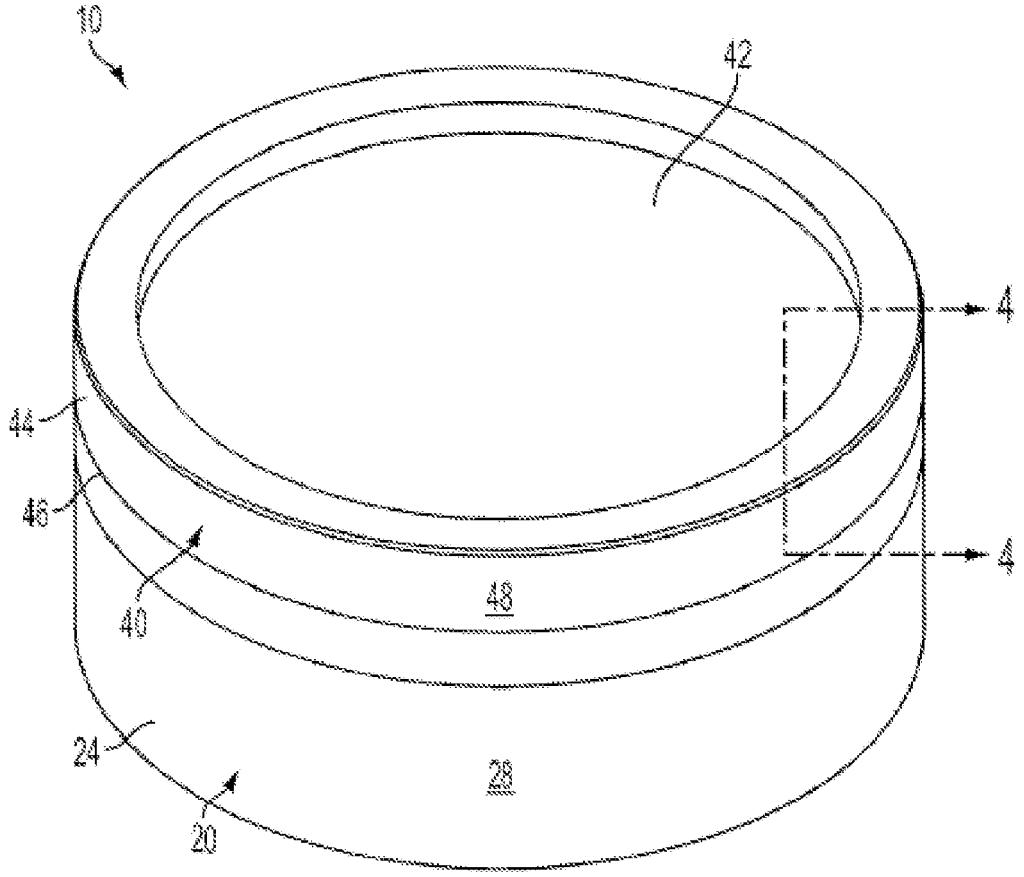
Figure 2:
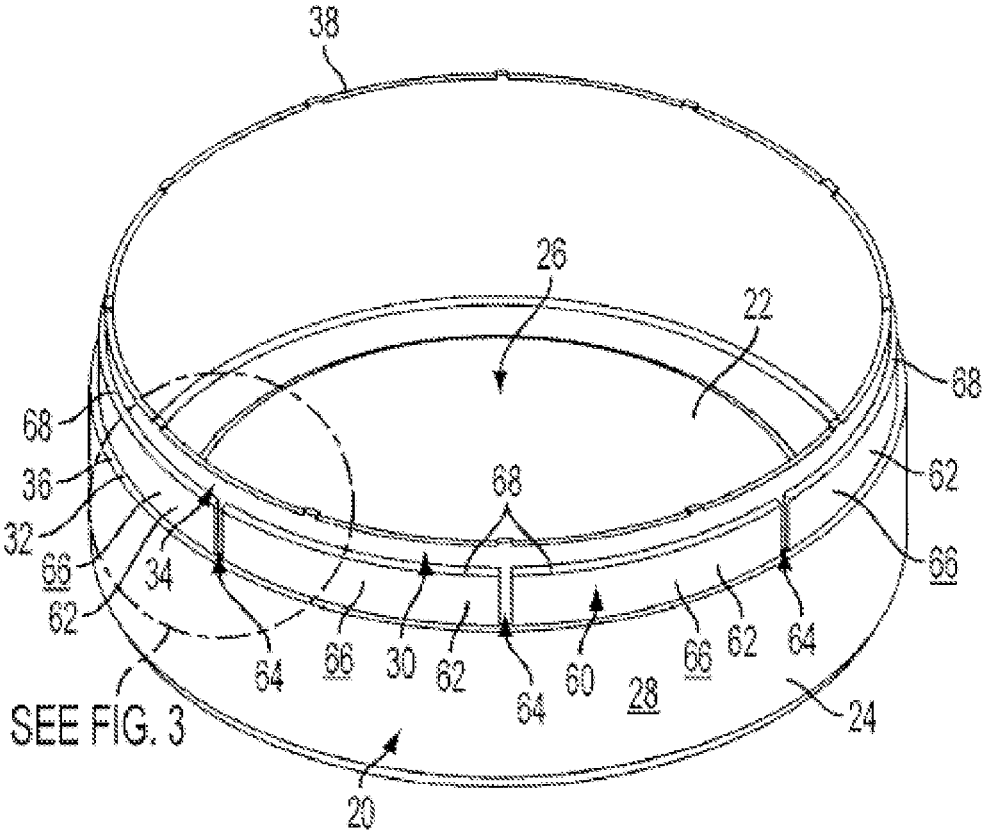
Figure 3:
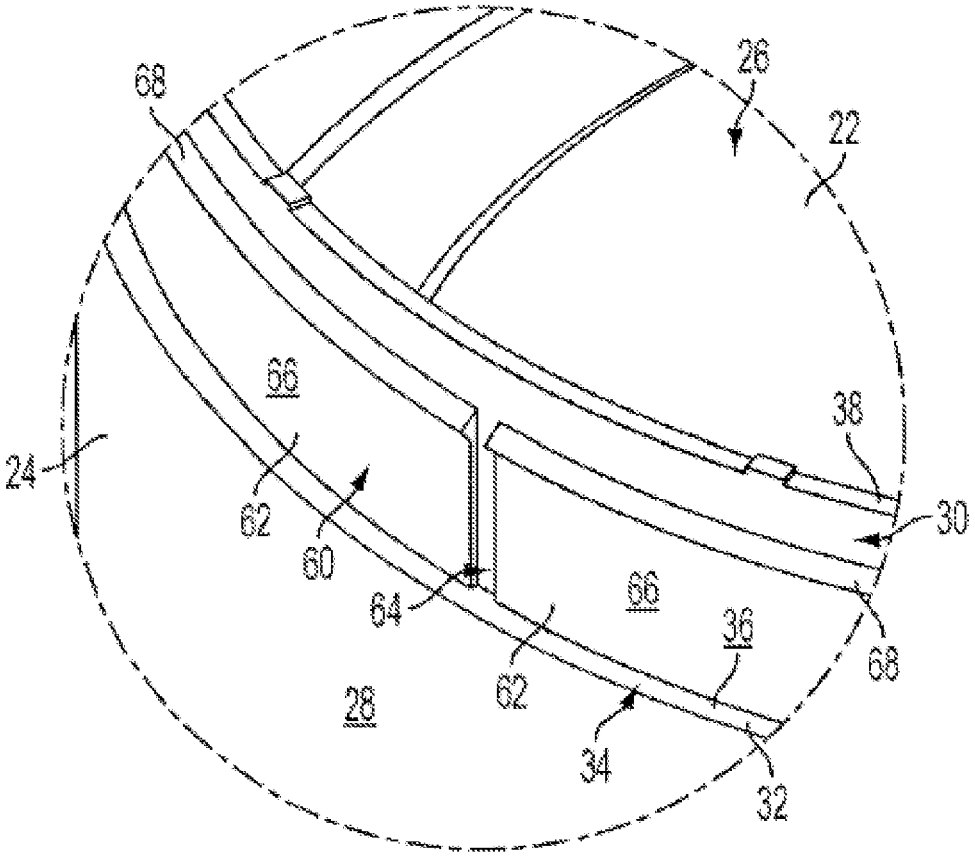
Figure 4:
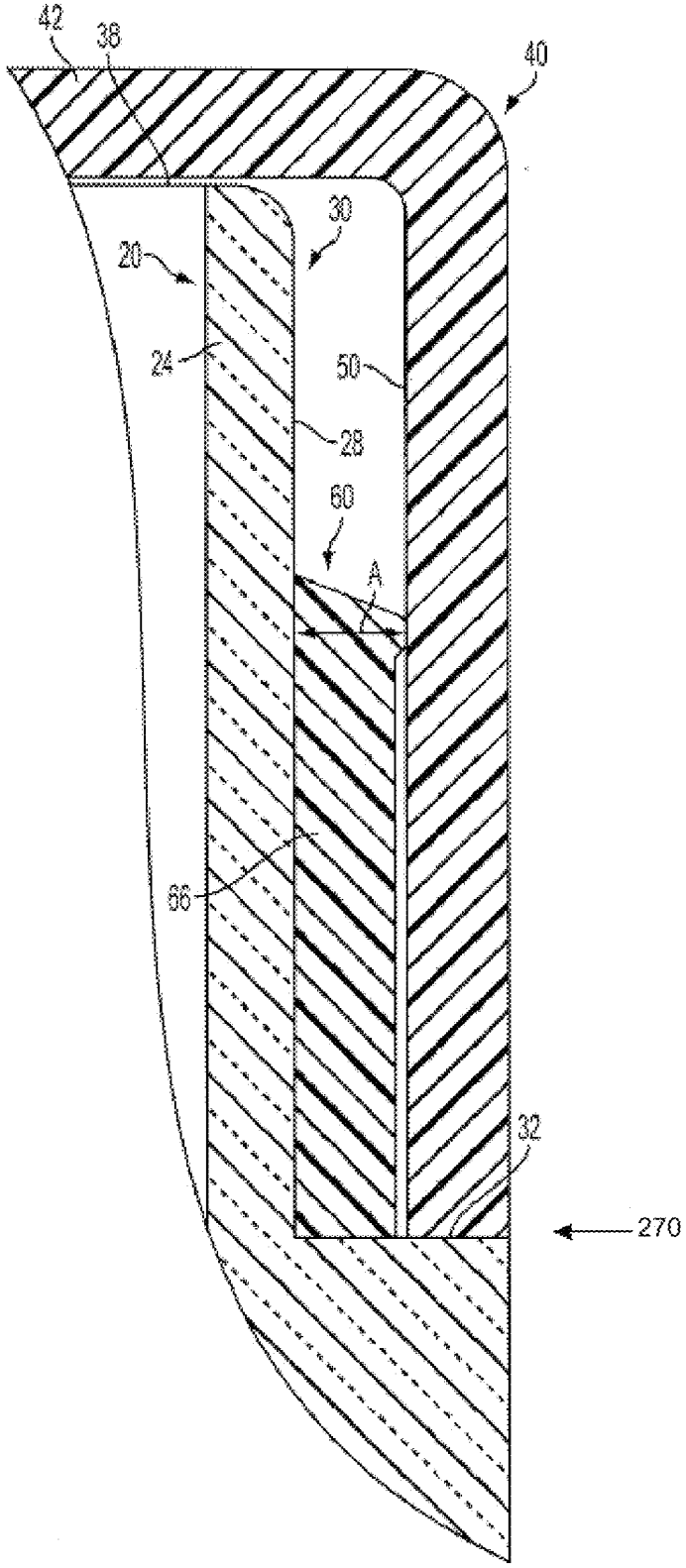
Figure 5:
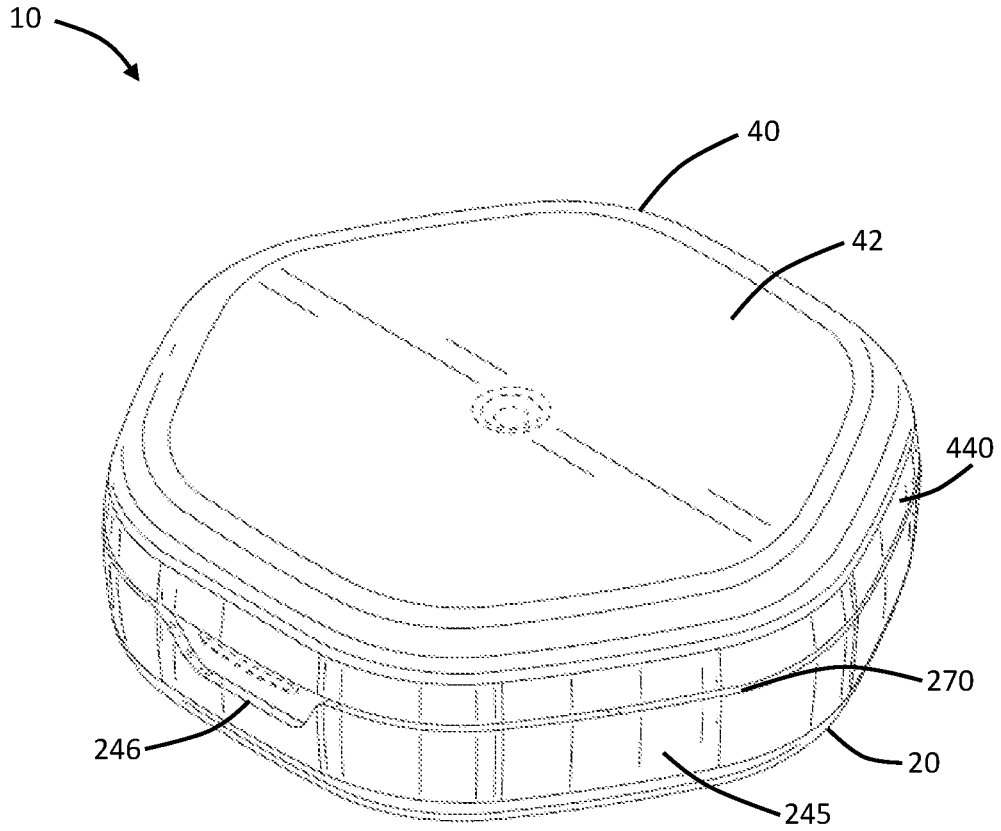
Figure 6:
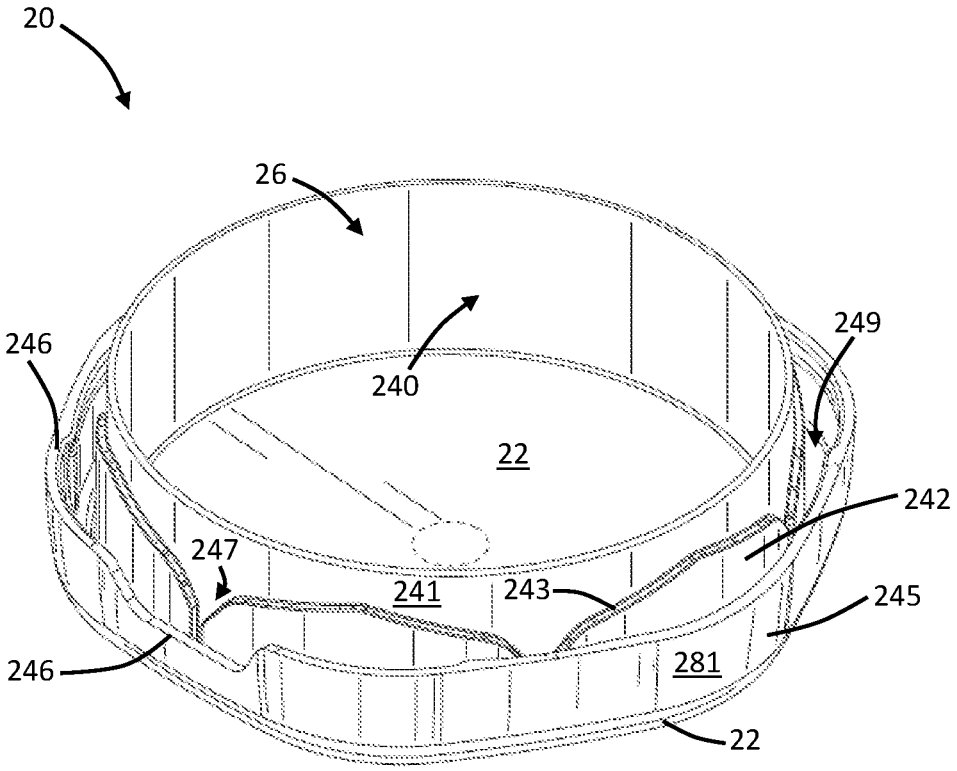
Figure 7:
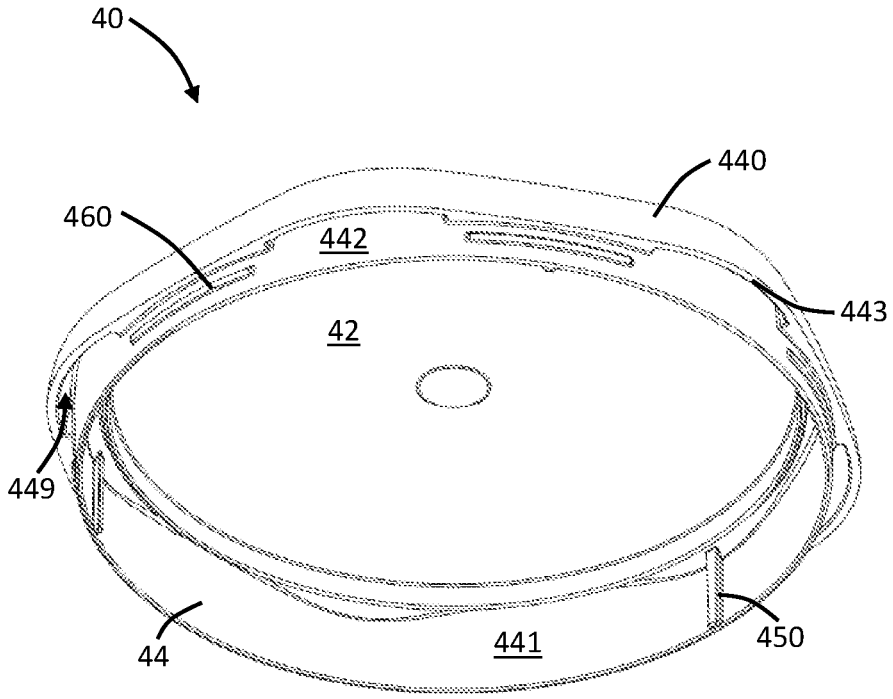
Figure 8:
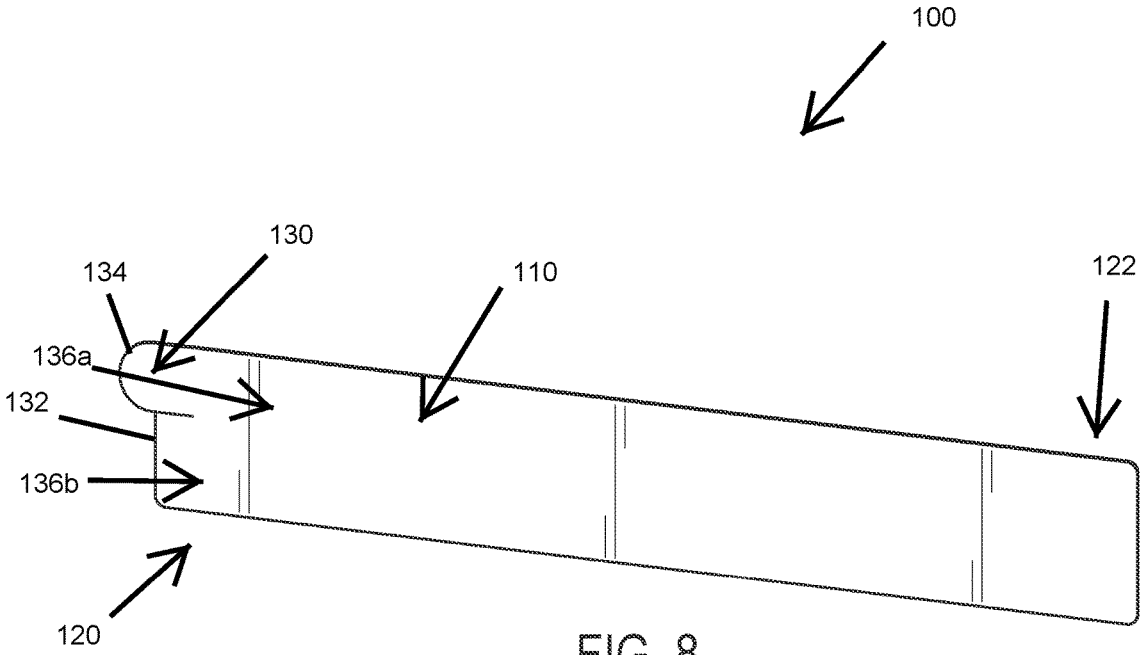
Figure 9:
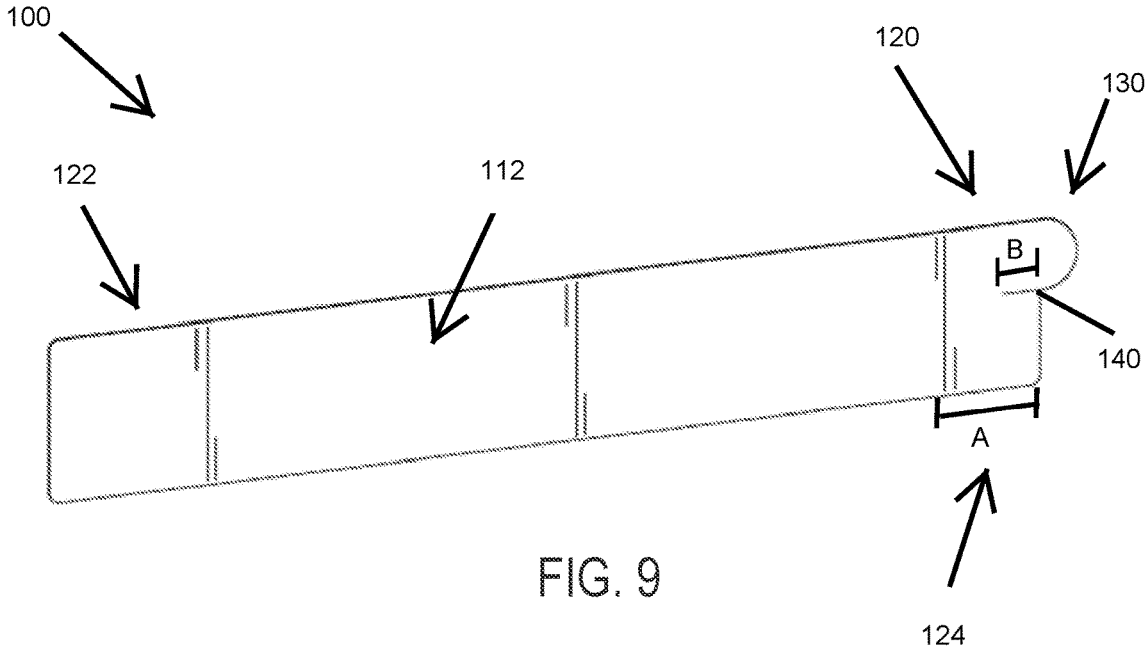
Figure 10:
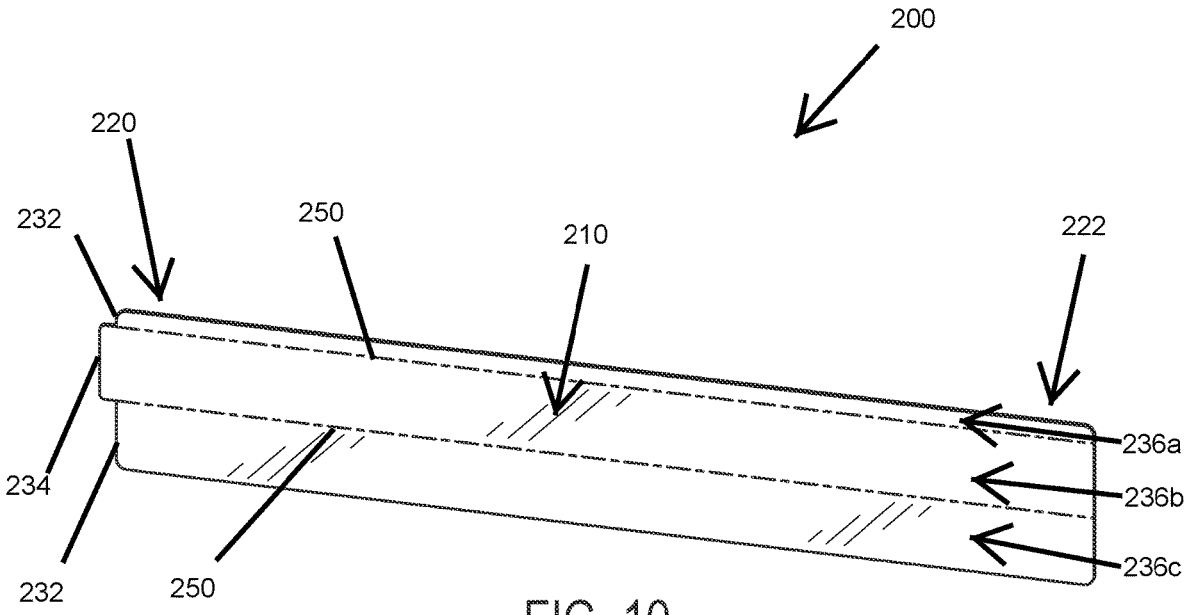
Figure 11:
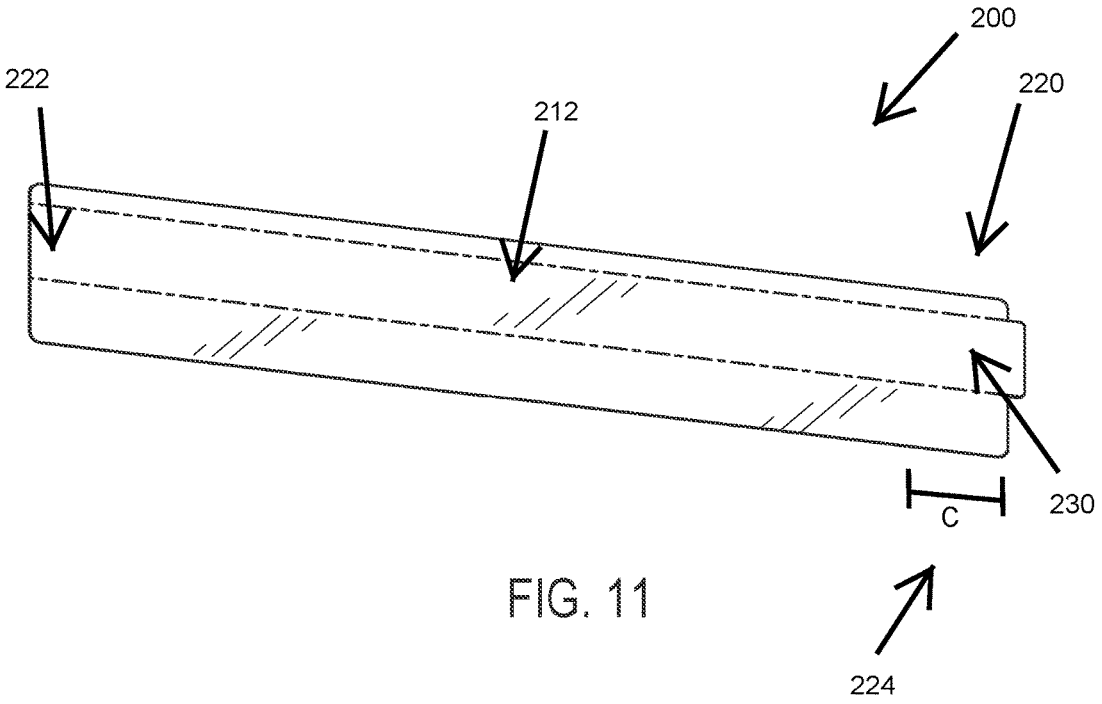
Figure 12:
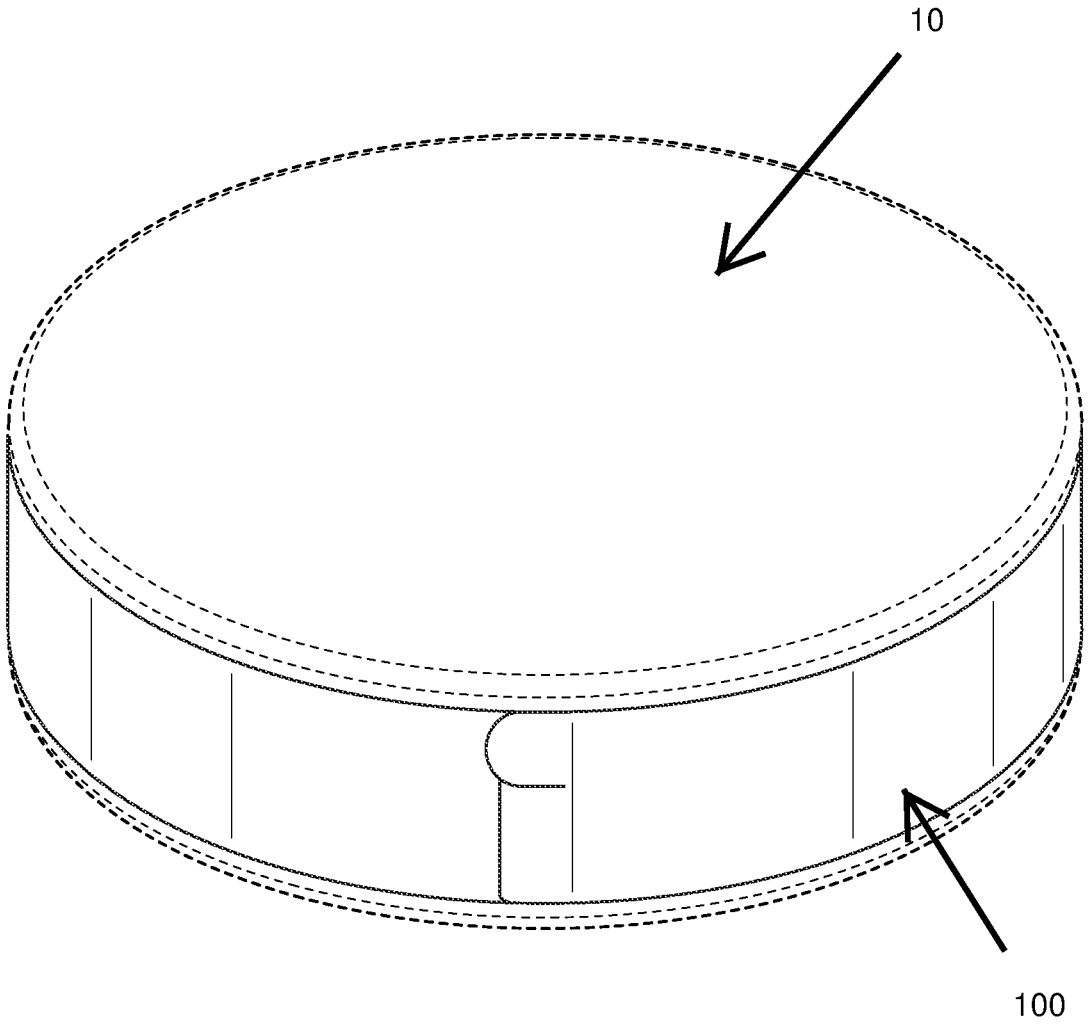
Figure 13:
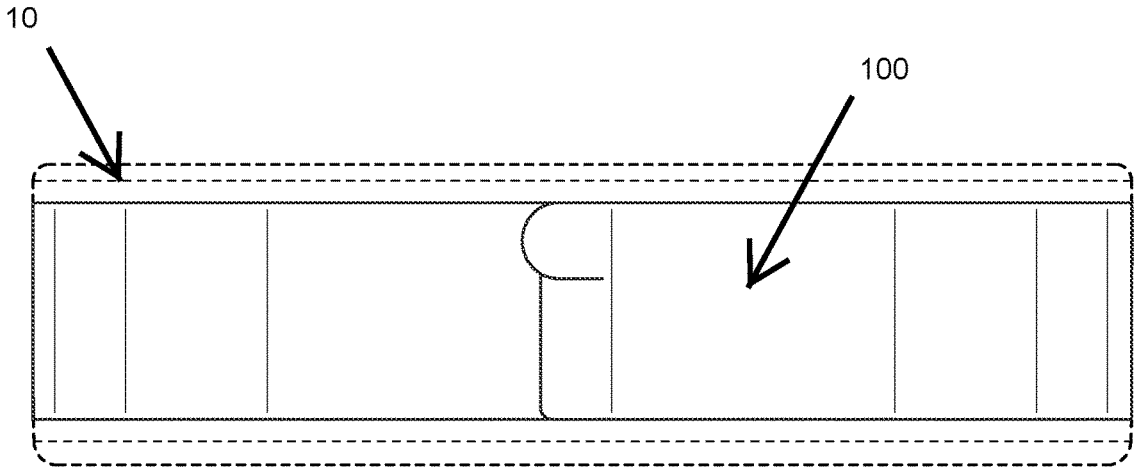
Figure 14:
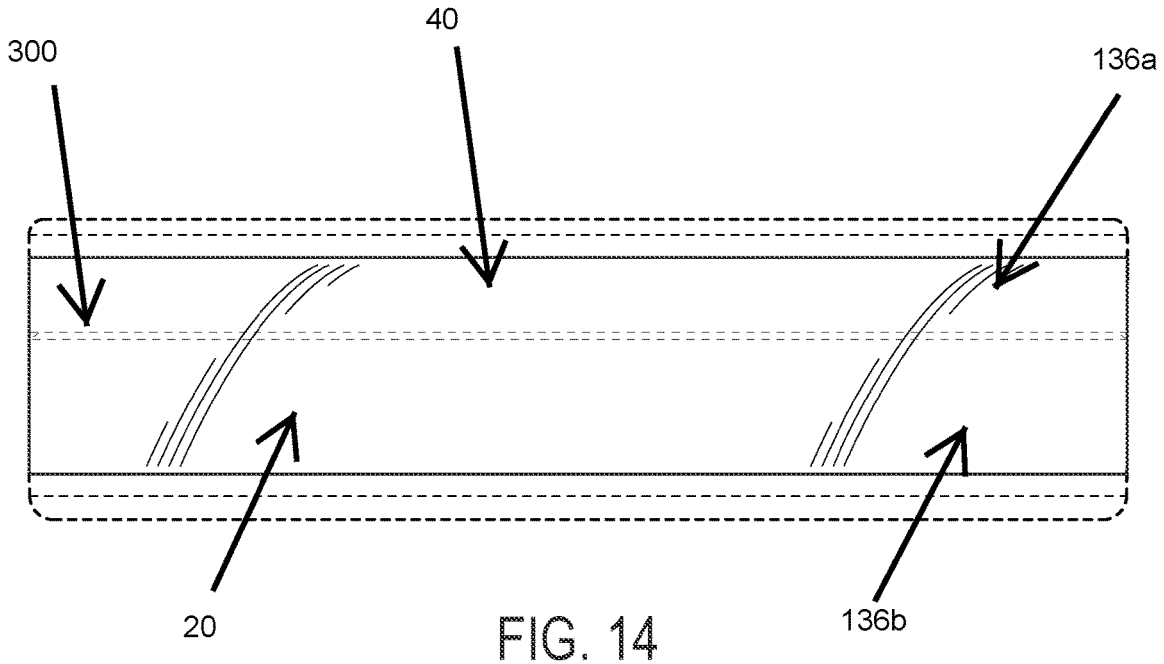
Figure 15:
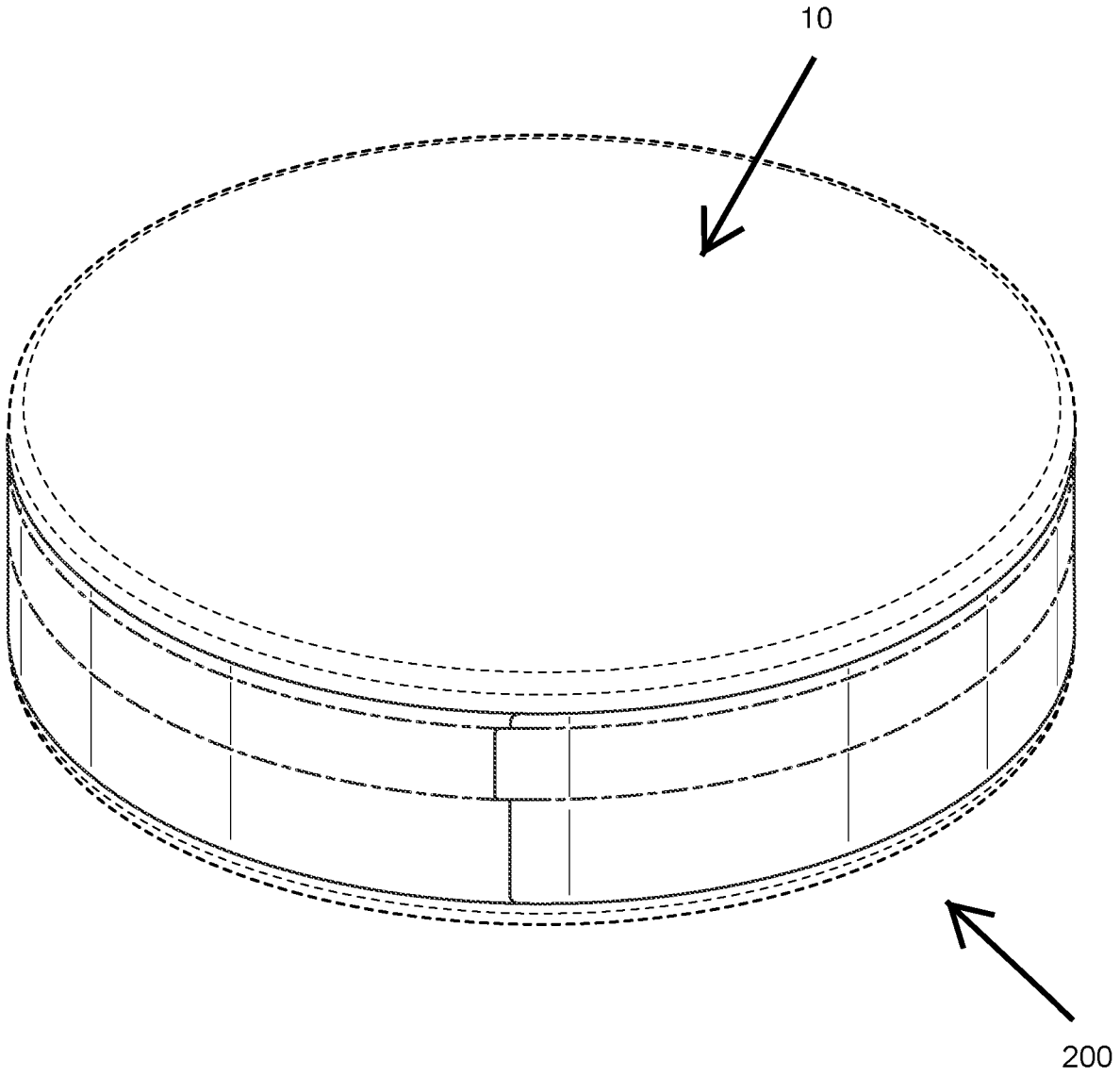
Figure 16:
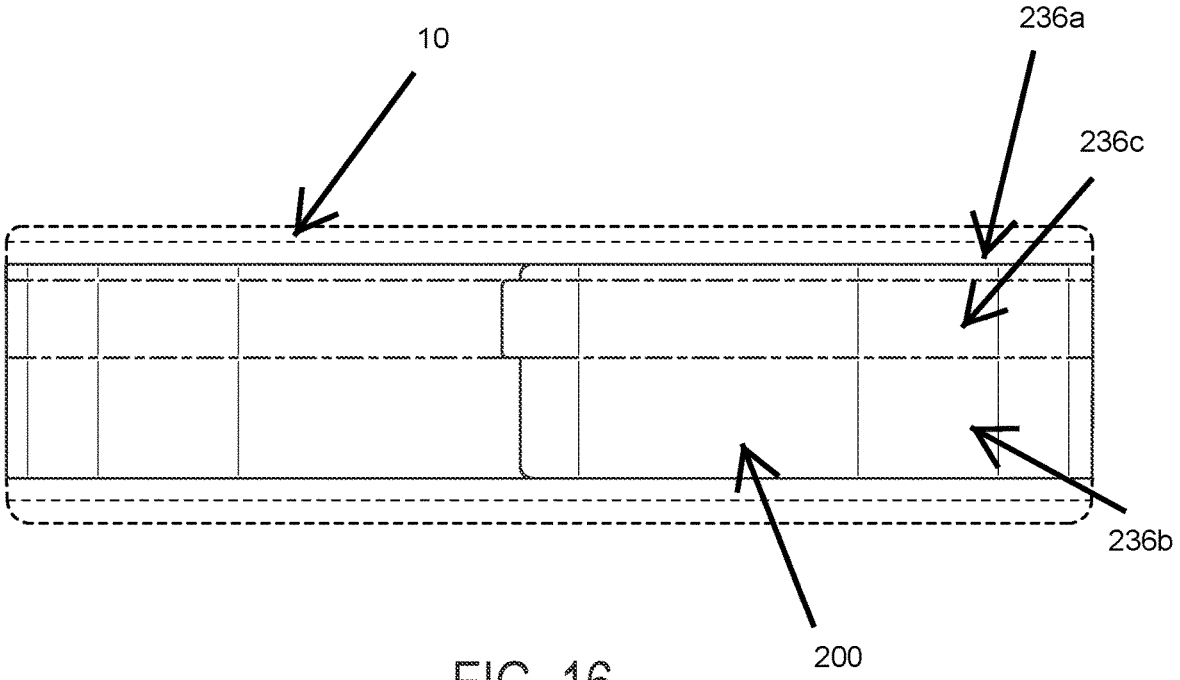
Figure 17:
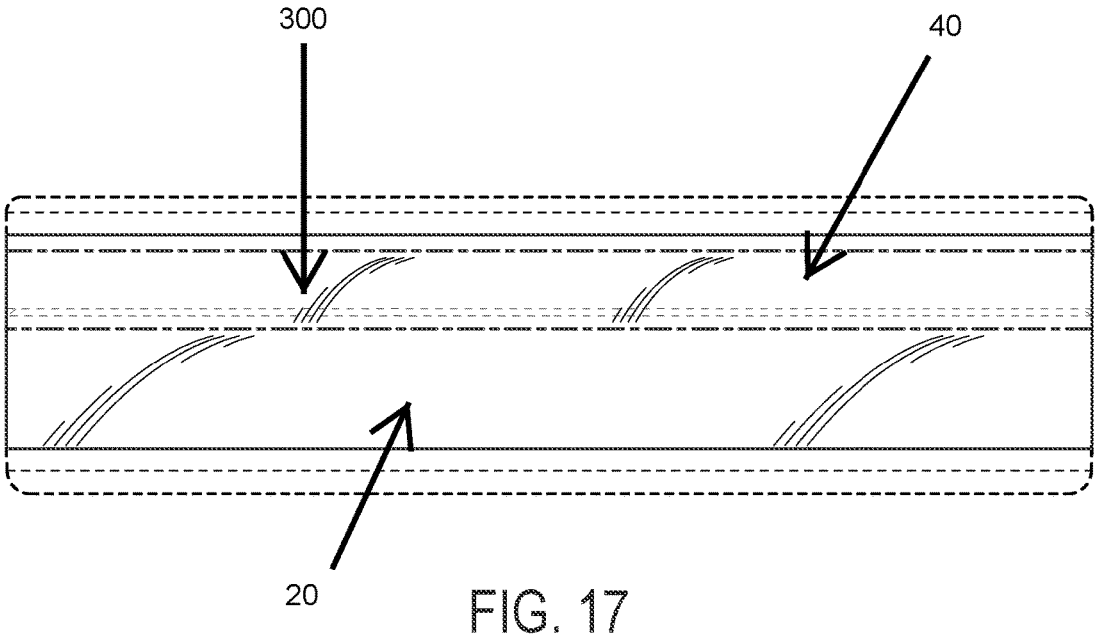

Having thus described the disclosure in general terms, reference will now be made to the accompanying drawings, which are not necessarily drawn to scale, and wherein:

FIG. 1 illustrates a container for use in an example embodiment of the present disclosure;

FIG. 2 illustrates a body of a container for use in an example embodiment of the present disclosure;

FIG. 3 is a magnified view of a portion of the body of FIG. 2;

FIG. 4 is a magnified sectional view on the line 4-4 of FIG. 1;

FIG. 5 illustrates a container for use in an example embodiment of the present disclosure;

FIG. 6 illustrates a body portion of the container of FIG. 5;

FIG. 7 illustrates a cover portion of the container of FIG. 5;

FIG. 8 illustrates a front view of a sealing member according to an example embodiment of the present disclosure;

FIG. 9 illustrates a back view the sealing member of FIG. 8;

FIG. 10 illustrates a front view of a sealing member according to an example embodiment of the present disclosure;

FIG. 11 illustrates a back view the sealing member of FIG. 10;

FIG. 12 illustrates a container with a sealing member adhered to a portion of the exterior surface of the container according to an example embodiment of the present disclosure;

FIG. 13 illustrates a front view of the embodiment illustrated in FIG. 12;

FIG. 14 illustrates a container with a transparent sealing member adhered to a portion of the exterior surface of the container according to an example embodiment of the present disclosure;

FIG. 15 illustrates a container with a sealing member adhered to a portion of the exterior surface of the container according to an example embodiment of the present disclosure;

FIG. 16 illustrates a front view of the embodiment illustrated in FIG. 15; and FIG. 17 illustrates a container with a transparent sealing member adhered to a portion of the exterior surface of the container according to an example embodiment of the present disclosure.

DETAILED DESCRIPTION OF THE DISCLOSURE

The present disclosure now will be described more fully hereinafter with reference to certain preferred aspects. These aspects are provided so that this disclosure will be thorough and complete, and will fully convey the scope of the disclosure to those skilled in the art. Indeed, the disclosure may be embodied in many different forms and should not be construed as limited to the aspects set forth herein; rather, these aspects are provided so that this disclosure will satisfy applicable legal requirements. As used in the specification, and in the appended claims, the singular forms "a", "an", "the", include plural referents unless the context clearly dictates otherwise.

In various embodiments of the present invention, a packaged container having an exterior sealing member effective to at least partially seal the container is provided. The sealing member can have a pull tab and can be continuous and uninterrupted along an interface of the sealing member with the container, which can limit moisture transfer between an interior of the container and an exterior environment. In some embodiments, the sealing member can facilitate opening and/or removal of a separate label or film upon a first opening of the container. The embodiments described in the present application can be used to store any solid products, but are particularly well-suited for products designed for oral consumption. Example consumable products that are often packaged in such containers include a wide variety of consumer products, including tobacco products and non-tobacco containing oral products, as described in more detail below.

Example containers useful in the present invention are disclosed in U.S. Pat. Pub. No. 2012/0193265 to Patel et al., which is herein incorporated by reference. The shape of the outer surface of the containers of the disclosure can vary. Although the container embodiments illustrated in the drawings have certain contours, containers with other exterior surface designs could also be used. For example, the sides or edges of the containers of the disclosure could be flattened, rounded, or beveled, and the various surfaces or edges of the container exterior could be concave or convex. Further, the opposing sides, ends, or edges of the container can be parallel or non-parallel such that the container becomes narrower in one or more dimensions. Container shape may be characterized in relation to a shape of a horizontal cross-section of the container. Typically, such cross-sectional shape may be substantially round or defining a circle. Other cross-sectional shapes are also encompassed, however, including oval, elliptical, triangular, square, rectangle, parallelogram, pentagon, hexagon, heptagon, octagon, and other geometric shapes.

The dimensions of the containers described herein can vary without departing from the disclosure. However, in preferred embodiments, the containers of the disclosure can be described as having a size suitable for handheld manipulation and operation. Example length and width for such handheld embodiments can independently be in the range of about 50 mm to about 100 mm, and more typically about 60 mm to about 80 mm. Such range may expressly be a largest length and/or width, a smallest length and/or width, or an average length and/or width. Example wall thicknesses include the range of about 0.5 mm to about 1.5 mm, and more typically about 0.8 mm to about 1.4 mm. Example depths for handheld container embodiments of the present disclosure range from about 5 mm to about 50 mm, more typically about 8 mm to about 30 mm, and most often about 15 mm to about 25 mm. Depth may be defined independent from any lid that is applied to the container and thus may be measured from the uppermost portion of a sidewall to the outer surface of a bottom wall of the container. In some embodiments, depth may be measured inclusive of an attached lid. Likewise, length and/or width for the container, as discussed above, can apply to a container lid as well. An example general outward appearance of the container is that used for commercially available GRIZZLY and KODIAK products that are marketed by American Snuff Company, LLC.

The number of solid product units stored in the containers of the disclosure can also vary, depending on the size of the container and the size of the product units. Typically, the number of stored product units will vary from about 5 to about 100, more typically about 10 to about 50, and most often about 15 to about 30. It is understood, however, that the content of any product stored in the containers can be defined based on the total volume of the container.

FIGS. 1-4 illustrate an example container 10 useful for storing a product and receiving a sealing member according to embodiments of the present disclosure. The illustrated embodiment is understood to provide only one example for the purposes of full description of the components that may be present in the container, and such components are understood to translate to further example container embodiments that may differ in shape, size, contouring, material of manufacture, or other characteristics and/or features. The container 10 may be formed by an open-ended body 20 and a cover 40. The body 20 has a bottom wall 22 (see FIG. 2), which, in some instances, may be substantially planar, and a side wall 24 depending from the bottom wall 22. In some embodiments, the side wall 24 and bottom wall 22 may be substantially cylindrical, as illustrated for the example embodiment. It is understood, however, that the bottom wall 22 may take on any exterior shape as desired for overall container, as already noted above, and the side wall 24 depending from the bottom wall 22 can have a corresponding shape. The side wall 24 defines a peripheral portion of the container 10 such that the side wall 24 includes an outer peripheral surface 28. The bottom wall 22 and the side wall 24 cooperate to define an internal storage compartment 26 for storage of a plurality of units of a product. In some instances, an upper portion 30 of the side wall 24 may define a lip 32 in such a manner that the upper portion 30 the side wall has a neck region 34 of reduced diameter (as compared to the diameter of the remainder of the outer surface of the side wall). Note that the location of the lip 32 along the side wall 24 of the body 20 can vary without departing from the present disclosure, meaning that distance between the lip 32 and the top edge 38 of the body 20 is not critical to the present disclosure.

The cover 40 may be provided for enclosing the units of product within the internal storage compartment 26. In this regard, the cover 40 is typically removably secured to the body 20 by a snap-fit or an interference fit. As shown in FIG. 1, the cover 40 has a top wall 42, which, in some instances, may be substantially planar, and a peripheral flange 44 depending from the top wall 42 which, in some instances, may be cylindrical. The cover 40 may have an overall shape that corresponds to the overall shape of the container 10. As such, the top wall 42 may have any external shape as otherwise described herein, and the peripheral flange 44 may have a corresponding shape. The peripheral flange 44 of the cover 40 is received over the side wall 24 of the body 20 so as to form an enclosure therebetween. The peripheral flange 44 includes a substantially flat or smooth inner surface 50 (FIG. 4). That is, the inner surface 50 typically does not include any protrusions, projections, ribs, or the like for interacting with the outer peripheral surface 28 of the side wall 24 of the body 20. In this regard, the inner surface 50 is substantially smooth and continuous about the cylindrical configuration thereof. In some instances where the lip 32 is provided on the body 20, at least a portion of an edge 46 of the peripheral flange 44 may interact with a surface 36 of the lip 32 to form a stop when the cover 40 is received upon the body 20. In other words, in instances in which the edge 46 interacts with the lip 32, at least a portion of the edge 46 of the cover 40 will abut a portion of the surface 36 when the cover 40 is fully seated upon the body. The edge 46 and surface 36 are typically planar, but it will be appreciated that one or both of the edge 46 and surface 36 may comprise a non-planar profile in some embodiments. For example, the edge 46 and surface 32 may comprise corresponding profiled engagement surfaces in some embodiments.

An outer surface 48 of the cover 40 will typically have the same approximate size or diameter as the side wall 24 of the body 20 such that the cover and body form a smooth exterior surface when the cover is placed over the neck region 34 of the side wall and fully seated upon the body. Hence, the container 10 may be compact and substantially flat so as to be suitable for storage and transportation by a user.

The material of construction of the container 10 can vary. Example materials include metal, wood, and synthetic plastic (i.e., polymeric) materials. Polymeric materials that can be extruded and/or molded into desired shapes are typically utilized, such as polyethylene, polypropylene, polystyrene, polyamide, and the like. Example metallic materials include aluminum, stainless steel, tinplate, and the like. In some embodiments, the body 20 is formed from a polymeric material, while the cover 40 is formed from a metallic material; however, the body 20 and the cover 40 may be formed from the same type of material or may be formed from different types of the same material (e.g., body and cover both formed of plastic but made from different polymeric materials) Example covers formed from metallic materials are those used for commercially available CAMEL Snuff, GRIZZLY and KODIAK products that are marketed by American Snuff Company, LLC. Example bodies are those that incorporate polymeric materials such as those types of materials used for the same products.

In various embodiments, the container can include a means for securing or sealing the cover to the body of the container, defining a joint extending around a periphery of the container. See, e.g., U.S. Pat. Pub. No. 2014/0197054 to Pipes et al, which is herein incorporated by reference. For example, in certain embodiments, the container can include a rib structure (as described in U.S. Pat. Pub. No. 2012/0193265 to Patel et al., which is herein incorporated by reference) applied to the body 20 e.g., via plastic injection molding). As particularly shown in FIGS. 2 and 3, projecting from the outer peripheral surface 28 of the body 20 (and, when provided, the neck region 34) is a circumferential rib structure 60 configured to form a seal with the cover 40. In some aspects, the rib structure may be integrally formed with the side wall 24 of the body 20, such as, for example, when the body 20 is formed by a plastic injection molding process. In other instances, the rib structure 60 may be a separate and discrete component secured or otherwise affixed to the side wall 24 with appropriate mechanical fasteners or adhesive (e.g., an epoxy adhesive). According to some aspects of the present disclosure, the rib structure 60 may be formed by a plurality of rib segments 62 arranged in spaced relation around the periphery of the side wall 24 of the body 20 (e.g., positioned circumferentially about the side wall 24 of the body 20 where the container body is cylindrical). Any number of rib segments 62 may be provided in containers useful in the present invention (e.g., about 2 to about 20 rib segments or about 5 to about 15 rib segments), although a preferred embodiment includes twelve such rib segments. Each rib segment 62 is separated from the next adjacent rib segment 62 by a vent channel 64. Each rib segment 62 may include a rib wall 66 and a rib projection 68. As shown in FIG. 4, the rib projections 68 interact with the peripheral flange 44 of the cover 40 in an interference fit when the cover is positioned over the side wall 24 of the body 20, so as to form a seal therebetween. In this regard, the rib projections 68 force the peripheral flange 44 outward of the outer peripheral surface 28 to form a tight fit at the joint when the cover 40 is engaged with the body 20.

In some embodiments, the internal storage space 26 may be divided into a first internal storage space and a second internal storage space. Alternatively, the second internal storage space may be defined in the cover 40. The second internal storage space may be configured to store additional product, which may the same product or a different product relative to the product that is stored in the first internal space. In some embodiments, the second internal storage space may be used to hold or store waste or spent materials.

Another example embodiment of a container 10 is shown in FIGS. 5 through 7. The container 10 may be formed by an open-ended body 20 and a cover 40. The body 20 has a bottom wall 22, which, in some instances, may be substantially planar. The body 20 also includes an inner side wall 240 depending from the bottom wall 22 and an outer side wall 245 also depending from the bottom wall 22. The inner side wall 240 and the outer side wall 245 are spaced apart so that there is a gap 249 therebetween. In some embodiments, the inner side wall 240 may be substantially cylindrical, while the bottom wall 22 and the outer side wall 245 may also be cylindrical (i.e., having a horizontal cross-sectional shape that is substantially round); however, in certain embodiments (as illustrated), the bottom wall 22 and the outer side wall 245 may define a different shape (i.e., having a non-round, horizontal cross-sectional shape). As illustrated, the bottom wall 22 and the outer side wall 245 define a substantially hexagonal shape. It is understood, however, that any shape as already noted above may be utilized. The outer side wall 245 defines a peripheral portion of the body 20 such that the outer side wall 245 includes an outer peripheral surface 281 that forms the outermost side surface of the body 20. The outer side wall 245 can include one or more cut-outs 246 that can be used for manipulating the cover 40 from the body 20 to access the product stored in the container 10.

The bottom wall 22 and the inner side wall 240 cooperate to define an internal storage compartment 26 for storage of a plurality of units of a product. The inner side wall 240 can be substantially perpendicular to the bottom wall 22 and can extend directly upward therefrom. The outer side wall 245 can be substantially continuous with the bottom wall 22 so as to have a curved transition between the bottom wall 22 and the outer side wall 235. The inner side wall 240 can include a plurality of aligning tabs 242 positioned on an outer surface 241 of the inner side wall 240. The aligning tabs 242 can interact with aligning ribs present on the cover 40, as described below, to provide proper alignment of the cover 40 with the body 20 so that the cover and the body align based on the exterior shape thereof. In this regard, the aligning tabs 242 can have an outer edge 243 arranged so that the aligning tabs have a substantially arched shape, and the outer edge 243 can have a width that corresponds to a thickness of the aligning tabs 242. Adjacent aligning tabs meet to substantially form a groove 247.

The cover 40 may be provided for enclosing the units of product within the internal storage compartment 26. In this regard, the cover 40 is typically removably secured to the body 20 by a snap-fit or an interference fit. In FIGS. 1 through 4, the cover 40 has a top wall 42, which, in some instances, may be substantially planar, and a peripheral flange 44 depending from the top wall 42. The cover 40 also can include an outer wall 440 that extends from the top wall 42. The outer wall 440 can be substantially continuous with the top wall 42 so as to have a curved transition between the top wall 42 and the outer wall 440. The cover 40 may have an overall shape that corresponds to the overall shape of the container 10. As such, the top wall 42 may have any external shape as otherwise described herein, and the outer wall 440 may have a corresponding shape. The peripheral flange 44 preferably has an external shape that substantially corresponds to an external shape of the inner side wall 240 of the body 20. The peripheral flange 44 and the outer wall 440 are spaced apart so that there is a gap 449 therebetween. In some embodiments, the gap 449 of the cover 40 is less than the gap 249 of the body 20. The peripheral flange 44 can include a plurality of ribs 450 positioned on an inner surface 441 thereof and can be substantially vertically arranged (i.e., substantially perpendicular to the plane of the top wall 42). The peripheral flange 44 also can include a plurality of protrusions 460 positioned on an outer surface 442 thereof and can be substantially horizontally arranged (i.e., substantially parallel to the plane of the top wall 42). The protrusions 460 can interact with a corresponding member on an inner portion of the outer side wall 245 of the body 20 to provide a snap fit or similar connection between the body 20 and the cover 40.

The peripheral flange 44 of the cover 40 is received over the inner side wall 240 of the body 20 so as to form an enclosure therebetween. The peripheral flange 44 includes a substantially flat or smooth inner surface 441 with the exception of the ribs 450, if present. The ribs 450 can function to self-align the cover 40 with the body 40 since the shape of the aligning tabs 242 encourage the ribs 450 of the cover to slide towards the grooves 247 therebetween. Peaks of the aligning tabs 242 and the grooves 247 therebetween can be positioned relative to the ribs of the peripheral flange 44 so that linear portions of the cover 40 align with linear portions of the body 20 and corners of the cover align with corners of the body 20, the linear portions and corners being referenced relative to the horizontal cross-sectional shape of the body 20 and the cover 40. When the cover 40 is engaged with the body 20, a bottom edge 443 of the outer wall 440 of the cover 40 can be positioned adjacent a top edge 246 of the outer side wall 245 of the body 20 so as to define a joint 270 extending around a periphery of the container 10. Note that is can be beneficial for the cut-out 246 to be expressly absent so as to minimize the area defined by the joint 270.

In various embodiments, the container can contain a product and optionally can include a label positioned on an exterior surface of the container. In some embodiments, the label can comprise a paper material, a polymer material (e.g., a web made of one or more polymer components), and combinations thereof. The label further can include an adhesive layer on at least a portion of a rear surface thereof for use in adhering the label to the container.

The label can be independent from a separate sealing member and can be provided solely for informational purposes. In such embodiments, the label typically will be present on a portion of an exterior surface of the container body, the container cover, or both. A separate sealing member then can be applied over at least a portion of the label, depending upon the positioning of a label. For example, a label present on the top wall of the container cover may not be covered by a sealing member. In some embodiments, a label may also be a sealing member as otherwise described herein. As such, the label and the sealing member may be combined into a single element. As such, description of the label may apply to the sealing member.

A label can include printing and/or imprinting to decorate the container and/or provide product identifying information. For example, a front surface of the label provided herein can include printed characters, symbols, pictures, designs, colors, or other indicia. In some embodiments, the product identifying information can identify a product brand, a company name, a corporate logo, a corporate brand, trademarks, tradenames, a marketing message, product strength, dosage information, active ingredient, ingredient lists and amounts, product manufacture date, product expiration date, product flavor, product pharmaceutical release profile, weight, product code (e.g., batch code), other product differentiating markings, and combinations thereof. As used herein, "product strength" refers to information that gives the user an indication of the amount of active ingredient within the pouch.

The product identifying information can be presented in such a way that a user of the product can discern the identifying information by visually inspecting the product and thereby differentiate or identify certain products. The product identifying information can be, for example, printed or dyed on the outer surface of the label, imprinted (e.g., embossed, debossed, or otherwise pressed) on the outer surface of the label, deposited on the outer surface of the label, adhered to the outer surface of the label, positioned in intimate contact with the outer surface of the label, woven or sewn onto the label, or otherwise attached to the outer surface of the label. In some embodiments, product identifying information can be provided by a selection of material (e.g., a material that is different in composition, different in color, different in texture, different in thickness, or different in some other defined property). In various embodiments, the product identifying information can be applied through heat and pressure. In some embodiments, product identifying information can be provided during application of the label as the container is manufactured. In various embodiments, product identifying information can be provided in a secondary process separate from a label application process. Product identifying information can be provided at any point during a container manufacturing process.

Example tobacco products which can be housed in the containers described herein include pelletized tobacco products (e.g., compressed or molded pellets produced from powdered or processed tobacco, such as those formed into the general shape of a coin, cylinder, bean, pellet, sphere, orb, strip, obloid, cube, bead, or the like), extruded or cast pieces of tobacco (e.g., as strips, films or sheets, including multilayered films formed into a desired shape), products incorporating tobacco carried by a solid substrate (e.g., where substrate materials range from edible grains to inedible cellulosic sticks), extruded or formed tobacco-containing rods or sticks, tobacco-containing capsule-like materials having an outer shell region and an inner core region, straw-like (e.g., hollow formed) tobacco-containing shapes, sachets or packets containing tobacco (e.g., snus-like products), pieces of tobacco-containing gum, and the like. Further, example tobacco products include tobacco formulations in a loose form such as, for example, a moist snuff product. Example loose form tobacco used with the containers of the present disclosure may include tobacco formulations associated with, for example, commercially available GRIZZLY moist tobacco products and KODIAK moist tobacco products that are marketed by American Snuff Company, LLC.

Example oral product compositions that can be packaged in the containers of the present disclosure are set forth in, for example, U.S. Pat. No. 1,376,586 to Schwartz; U.S. Pat. No. 3,368,567 to Speer; U.S. Pat. No. 4,513,756 to Pittman et al.; U.S. Pat. No. 4,606,357 to Dusek et al; U.S. Pat. No. 4,821,749 to Toft et al.; U.S. Pat. No. 5,167,244 to Kjerstad; U.S. Pat. No. 5,387,416 to White; U.S. Pat. No. 6,668,839 to Williams; U.S. Pat. No. 7,810,507 to Dube et al.; U.S. Pat. No. 7,819,124 to Strickland et al.; U.S. Patent Pub. Nos. 2005/0244521 to Strickland et al.; 2006/0191548 to Strickland et al.; and 2008/0029116 to Robinson et al.; U.S. Pat. No. 4,624,269 to Story et al.; U.S. Pat. No. 4,975,270 to Kehoe; and U.S. Pat. No. 4,802,498 to Ogren. The format of oral compositions can vary, and include pouched products containing a powdered or granular composition, lozenges, pastilles, liquids, gels, emulsions, meltable compositions, and the like. See, for example, the types of products described in US Patent App. Pub. Nos. 2022/0160675 to Gerardi et al.; 2022/0071984 to Poole et al.; 2021/0378948 to Gerardi et al.; 2021/0330590 to Hutchens et al.; 2021/0186081 to Gerardi et al.; 2021/0177754 to Keller et al; 2021/0177043 to Gerardi et al.; 2021/0177038 to Gerardi et al.; 2021/0169867 to Holton, Jr. et al.; 2021/0169792 to Holton, Jr. et al.; 2021/0169132 to Holton, Jr. et al.; 2021/0169121 to St. Charles, and 2021/0169122 to St. Charles. Various manners or methods for packaging oral products are set forth in U.S. Patent Pub. Nos. 2004/0217024 and 2006/0118589 to Arnarp et al.; and 2009/0014450 to Bjorkholm; and PCT Pub. Nos. WO 2006/034450 to Budd; WO 2007/017761 to Kutsch et al.; and WO 2007/067953 to Sheveley et al. All of the above-cited references are incorporated by reference herein in their entirety.

Compositions utilized as the product contained in the containers of the disclosure will often include such ingredients as tobacco (typically in particulate form), actives, botanicals, sweeteners, binders, colorants, pH adjusters, fillers, flavoring agents, disintegration aids, antioxidants, oral care additives, and preservatives. See, for example, U.S. Pat. No. 7,861,728 to Holton et al., which is incorporated by reference herein in its entirety.

The oral product formulation can be contained within a container, such as a pouch or bag, such as is the type commonly used for the manufacture of snus types of products (e.g., a sealed, moisture permeable pouch that is sometimes referred to as a "portion"). A representative moisture permeable pouch can be composed of a "fleece" type of material. The product is in turn contained within a package, such as the containers disclosed in U.S. Pat. Pub. No. 2012/0193265 to Patel et al., which is herein incorporated by reference. The package is sealed tightly, and is composed of a suitable material, such that the atmospheric conditions within that sealed package are modified and/or controlled. That is, the sealed package can provide a good barrier that inhibits the passage of compositions such as moisture and oxygen therethrough. In addition, the atmosphere within the sealed package can be further modified by introducing a selected gaseous species (e.g., nitrogen, argon, or a mixture thereof) into the package prior to sealing or by drawing a vacuum therein (vacuum sealing). As such, the atmospheric conditions to which the tobacco composition is exposed are controlled during conditions of preparation, packing, storage and handling.

An example pouch may be manufactured from materials, and in such a manner, such that during use by the user, the pouch undergoes a controlled dispersion or dissolution. Such pouch materials may have the form of a mesh, screen, perforated paper, permeable fabric, or the like. For example, pouch material manufactured from a mesh-like form of rice paper, or perforated rice paper, may dissolve in the mouth of the user. As a result, the pouch and tobacco formulation each may undergo complete dispersion within the mouth of the user during normal conditions of use, and hence the pouch and tobacco formulation both may be ingested by the user. Other example pouch materials may be manufactured using water dispersible film forming materials (e.g., binding agents such as alginates, carboxymethylcellulose, xanthan gum, pullulan, and the like), as well as those materials in combination with materials such as ground cellulosics (e.g., fine particle size wood pulp). Preferred pouch materials, though water dispersible or dissolvable, may be designed and manufactured such that under conditions of normal use, a significant amount of the tobacco formulation contents permeate through the pouch material prior to the time that the pouch undergoes loss of its physical integrity. If desired, flavoring ingredients, disintegration aids, and other desired components, may be incorporated within, or applied to, the pouch material. Descriptions of various components of snus products and components thereof also are set forth in U.S. Pat. Pub. No. 2004/0118422 to Lundin et al., which is incorporated herein by reference. See, also, for example, U.S. Pat. No. 4,607,479 to Linden; U.S. Pat. No. 4,631,899 to Nielsen; U.S. Pat. No. 5,346,734 to Wydick et al.; and U.S. Pat. No. 6,162,516 to Derr, and U.S. Pat. Pub. No. 2005/0061339 to Hansson et al.; each of which is incorporated herein by reference. See, also, the representative types of pouches, and pouch material or fleece, set forth in U.S. Pat. No. 5,167,244 to Kjerstad, which is incorporated herein by reference. Snus products can be manufactured using equipment such as that available as SB 51-1/T, SBL 50 and SB 53-2/T from Merz Verpackungmaschinen GmBH. G.D SpA out of Italy also supplies tobacco pouching equipment. Snus pouches can be provided as individual pouches, or a plurality of pouches and can be connected or linked together (e.g., in an end-to-end manner) such that a single pouch or individual portion can be readily removed for use from a one-piece strand or matrix of pouches.

In various embodiments, the container can be further sealed by a sealing member. As noted above, the sealing member may be configured as a label so as to provide the information, decoration, etc. that otherwise may be provided by a label. In some embodiments, the container comprises a sealing member and a separate label. In some embodiments, the container comprises a sealing member and not a label. In the express absence of a separate label, the container may include information directly printed or otherwise applied to the container body, container cover, or both. As used herein, the term "sealing member" refers to a material extending along and covering a joint of a container as described herein. The sealing member can be continuous and uninterrupted at least in the area of the container defining the joint thereof. As such, along the joint, the sealing member is not perforated, scored, or provided with like features that are configured to provide a pre-positioned line of weakness to encourage propagation of tearing. In some embodiments, however, perforations, scoring, or the like can be present on the sealing member above and/or below the portion of the sealing member covering the joint of the container. The sealing member can be configured so that tearing thereof will propagate along a dimension so as to be substantially parallel to the joint of the container.

FIGS. 8 and 9 illustrate an example embodiment of a sealing member 100 in accordance with the present disclosure. The sealing member 100 can have a front surface 110 and a rear surface 112. In some embodiments, the sealing member 100 can include any of the elements, configurations, and the like otherwise described herein that can be useful for a label.

In some embodiments, the rear surface 112 of the sealing member 100 can include an adhesive layer which allows the sealing member 100 to be adhered to the surface of another object. The entire rear surface 112 can include an adhesive layer. Alternatively, only a portion of the rear surface 112 or designated locations on the rear surface 112 of the sealing member 100 can comprise an adhesive layer, adhesive coating, or adhesive material applied thereto. In some embodiments, the adhesive further allows a portion of the rear surface 112 of the sealing member 100 to be adhered to a portion of the front surface 110 of the sealing member 100.

A sealing member 100 described herein can have a first end 122, a second end 120, and an interface 124. In some embodiments, the sealing member 100 can be a length so as when adhered to the periphery of the container, a section of the sealing member at the second end 120 will overlap a section of the sealing member at the first end 122. In some embodiments, the length of the sealing member can be a length that is at least 100% of the length of the perimeter of the container to which the sealing member is applied, such as about 102% to about 120% or about 105% to about 115% of the length of the perimeter of the container. The interface 124 may be the region of overlap of the first end 122 and second end 120, where the rear surface 112 may be adhered to the front surface 110. The interface 124 may have a defined length A, and may end prior to reaching a terminal edge 132 of the second end 120. Accordingly, the rear surface 112 of the second end 120 may not be adhered to the front surface 110 of the first end 122

In some embodiments, at least a portion of the rear surface 112 of the sealing member 100 may not have adhesive. In some embodiments, at least a portion of the rear surface 112 may comprise a varnish material on top of the adhesive. The varnish material may limit or eliminate the adherence of the rear surface of the second end 120 to the front surface 110 of the first end 122. For example, a portion of the rear surface of the first end may have a varnish material top coat, where the rectangular portion is placed so as to allow the rear surface of the pull tab to rest on top of the varnish material when the sealing member is adhered to the container. Accordingly, a portion of the sealing member 100 may not be adhered to the container, or to the front surface 110 of the sealing member 100. This portion may, in some embodiments, form a pull tab 130. In some embodiments, the pull tab 130 may be shaped to allow a user to grasp a portion of the second end. For example, as shown in FIGS. 8 and 9, in some embodiments, the end of the interface 124 may be defined with a terminal edge 132, and a curved 134 pull tab 130 extending at least a portion therefrom and forming the second end 120.

In some embodiments, the sealing member 100 can have a tearing propagation line 140. The tearing propagation line 140 may extend from the base of the pull tab into the interface at a defined distance B. In some embodiments, the defined distance is at least 2 mm and may be no more than about 15 mm, such as about 3 mm to about 12 mm or about 5 mm to about 10 mm. The tearing propagation line 140 may enable tearing, and the direction of tearing, of the sealing member 100 when the pull tab 130 is pulled. As such, when the sealing member 100 is adhered to the exterior surface of the container, pulling on the pull tab 130 may enable the tearing propagation line 140 to extend from the second end 120 towards the first end 122, thus tearing the sealing member 100 along an entirety of a length of the sealing member and allowing for the opening of the container. Upon tearing, the sealing member 100 can be separated into a top portion 136*a* that remains at least partially attached to the container cover 40 and a bottom portion 136*b* that remains at least partially attached to the container body 20.

FIGS. 10 and 11 illustrate another embodiment of a sealing member 200 in accordance with the present disclosure. The sealing member 200 can have a front surface 212 and a rear surface 210.

In some embodiments, the rear surface 210 of the sealing member 200 can include an adhesive layer which allows the sealing member 200 to be adhered to the surface of another object. The entire rear surface 210 can include an adhesive layer. Alternatively, only a portion of the rear surface 210 or designated locations on the rear surface 210 of the sealing member 200 can comprise an adhesive layer, adhesive coating, or adhesive material applied thereto. In some embodiments, the adhesive further allows the rear surface 210 of the sealing member 200 to be adhered to the front surface 212 of the sealing member 200.

A sealing member 200 described herein can have a first end 222, a second end 220, and an interface 224. In some embodiments, the sealing member 200 can be a length so as when adhered to the periphery of the container, the second end 220 will overlap the first end 222. The interface 224 may be the region of overlap of the first end 222 and second end 220, where the rear surface 210 may be adhered to the front surface 212. The interface may have a defined length C, and may end prior to reaching a terminal edge 232 of the second end 220. Accordingly, a portion of the rear surface 210 of the second end 220 may not be adhered to the front surface 212 of the first end 222.

In some embodiments, at least a portion of the rear surface 210 of the sealing member 200 may not have adhesive. In some embodiments, at least a portion of the rear surface 210 may comprise a varnish material on top of the adhesive. The varnish material may limit or eliminate the adherence of the rear surface of the second end 220 to the front surface 212 of the first end 222. Accordingly, a portion of the sealing member 200 from the interface 224 to the second end 222 may not be adhered to the container, or to the front surface 212 of the sealing member 200. This portion may form a pull tab 230. In some embodiments, the pull tab 230 may be shaped to allow a user to grasp the second end. For example, as shown in FIGS. 10 and 11, in some embodiments, the end of the interface 224 may be defined with a terminal edge 232, and a portion of the pull tab 230 can extend beyond the terminal edge 232, said portion of the pull tab defining a grasping edge 234.

In some embodiments, the sealing member 200 can have one or more perforated or fibrillated lines 250. The perforated or fibrillated lines 250 may extend along the length of the sealing member 200 from the first end 222 to the second end 220. In some embodiments, the perforated or fibrillated lines may have a depth of the thickness of the material. As such, when the sealing member 200 is adhered to the exterior surface of the container, the pull tab 230 may enable the tearing of the sealing member 200 along the perforated or fibrillated lines 250, thus removing the portion of the sealing member overlying the joint of the container and allowing the opening of the container. The positioning of the perforated or fibrillated lines 250 can be such that they are above and below the joint of the container so that middle portion of the sealing member that is removed by pulling on the pull tab 230 is adhered to both the container cover and the container body prior to removal. Upon tearing, the sealing member 200 can be separated into a top portion 236*a* that remains at least partially attached to the container cover 40, a bottom portion 236*b* that remains at least partially attached to the container body 20, and a middle portion 236*c* that is detached from the container 10.

The material of a sealing member described herein can comprise a paper material, a polymer material (e.g., a web made of one or more polymer components), and combinations thereof. In some embodiments the sealing member comprises a facestock, an adhesive, and a liner. In various embodiments, the facestock can be a machine direction oriented material, a polyolefin film, or a combination thereof. In some embodiments, the polyolefin may have a top coat that is print-receptive. In some embodiments, the polyolefin film may be semi-glossy. In some embodiments, the polyolefin film may be satin finished. In some embodiments, the polyolefin film may be transparent. In some embodiments, the polyolefin film may be colored. In some embodiments, the polyolefin film may be corona treated. In some embodiments, the polyolefin film may be bright and/or metallised. In various embodiments, the facestock can be a polyethylene film. In some embodiments, the polyethylene film may be corona treated. In some embodiments, the polyethylene film may have a print-receptive top coat. In some embodiments, the polyethylene film may be transparent. In some embodiments, the polyethylene film may be bright and/or metallised. In various embodiments, the facestock can be bi-axially oriented, a polypropylene film, or a combination thereof. In some embodiments, the polypropylene film may have a top coat that is print-receptive. In some embodiments, the polypropylene film may be transparent. In some embodiments, the polypropylene film may be colored. In some embodiments, the polypropylene film may be semi-glossy. In some embodiments, the polypropylene film may have a bottom coat comprising a silver layer. In some embodiments, the bottom coat may be opaque. In various embodiments the adhesive can be a general purpose permanent adhesive. In various embodiments, the adhesive can be a special purpose extra permanent adhesive. In some embodiments, the adhesive may comprise an acrylic material. In some embodiments, the acrylic material may be transparent. In some embodiments, the adhesive may comprise a rubber-based material. In some embodiments, the rubber-based material may be translucent or opaque. In various embodiments, the liner can be a paper material. In some embodiments, the paper material may be a supercalendered glassine paper. In some embodiments, the paper material may be colored. For example, the paper material may be FSC® certified paper.

While a combination of any of the disclosed materials may be applied, in some embodiments, the material of the sealing member comprises a polyolefin film facestock, a general purpose permanent adhesive, and a supercalendered glassine paper liner. The polyolefin film may be thin, white, and machine direction oriented, with a semi-gloss finish. The general purpose permanent adhesive may be acrylic-based, and transparent, or clear. The supercalendered glassine paper may be white in color. When applied to the embodiment in FIGS. 8 and 9, this combination of materials may allow the sealing member 100 to tear in a relatively straight line when the pull tab 130 is pulled. Because the embodiment in FIGS. 10 and 11 are perforated or fibrillated, the sealing material 200 may tear regardless of the material combination.

In some embodiments, as illustrated in FIGS. 12-14, for example, the sealing member 100 of FIGS. 8 and 9 can be adhesively bound to the container 10. In this embodiment, the rear surface 112 of the sealing member 100 can be adhesively bonded to the outer peripheral surface of the body 20 and to cylindrical outer surface of the cover 40, such that the sealing member 100 covers the joint 300 between the container body 20 and the container cover 40 of the container 10 in a closed position. The sealing member 100 may be positioned so as to allow the rear surface 112 of the sealing member 100 to be adhered to the cover 40 and body 20 between the joint 300 and the edges of the sealing member 100 to form a continuous and uninterrupted seal. It should be appreciated that the container body 20 and the container cover 40 are illustrated with dotted lines in FIGS. 12-14 because the shape of the container cover 40 and the container body 20 is not necessary for efficiency of the sealing member.

In some embodiments, as illustrated in FIGS. 15-17, for example, the sealing member 200 of FIGS. 10 and 11 can be adhesively bound to the container 10. In this embodiment, the rear surface 210 of the sealing member 200 can be adhesively bonded to the outer peripheral surface of the body 20 and to cylindrical outer surface of the cover 40, such that the sealing member 200 covers the joint 300 between the container body 20 and the container cover 40 of the container 10 in a closed position. The sealing member 200 may be positioned with the joint 300 between the perforated lines 250, so as to allow the rear surface 210 of the sealing member 200 to be adhered to the cover 40 and body 20 between the joint 300 and the perforated lines 250 to form a continuous and uninterrupted seal. It should be appreciated that the container body 20 and the container cover 40 are illustrated with dotted lines in FIGS. 15-17 because the shape of the container cover 40 and the container body 20 is not necessary for efficiency of the sealing member.

In various embodiments, the sealing member can limit moisture transfer through the joint of the container. For products having a defined moisture content, limiting the transfer of moisture from inside the container to outside the container can increase the shelf-life of the product. In some embodiments, a continuous and uninterrupted sealing member described herein can limit moisture transfer more so than a perforated or scored material.

Moisture transfer can be measured by any means known in the art. In some embodiments, moisture transfer is measured through daily water loss measurements of a product within the disclosed container sealed with the sealing member. For example, a lab tissue, or other material capable of absorbing water, may be placed inside the container body. A specific amount of water may be added to the lab tissue within the container body. The container body may then be sealed with the container cover, and the sealing member adhered to the periphery of the container. The weight of the container may then be measured and recorded, and then placed in a temperature and humidity-controlled storage chamber. In some embodiments, the temperature and humidity of the controlled storage chamber are ambient conditions, or 25° C.+2° C., and 60% RH+5% RH, respectfully. After the container is allowed to equilibrate within the storage chamber (after around 48 hours), the weight of the container may be measured and recorded. Keeping the container in the controlled storage chamber when not measuring, every 2-3 days the weight of the container may be measured and recorded over a period of time, such as one month. The daily water loss (mg/day) may then be calculated based upon the weight change of the container over time.

The adherence of the sealing member on either side of the joint, as disclosed herein, may lower moisture loss per day through the sealing member. In some embodiments, using the daily water loss measurement method described above, moisture loss through a sealing member described herein less than 2 mg/day. In some embodiments, moisture loss through a sealing member described herein is less than 1.5 mg/day. In some embodiments, moisture loss through a sealing member disclosed herein is less than 1.20 mg/day. Moisture loss through the sealing member is preferably as low as 0 mg/day, but may have an acceptable lower range of 0.2 mg/day or 0.1 mg/day.

A method for reducing moisture transfer is also provided. The method can include providing packaging comprising a body and a cover arranged to engage the body so as to define a joint extending around a periphery of the packaging. The method can also include positioning a product within the packaging, the product being a solid and having a defined moisture content. The method additionally includes adhering a sealing member at the joint. In some embodiments, the sealing member may limit moisture transfer through the joint as measured by a change in the defined moisture content of the product within the package of less than 2 mg/day. The method can limit moisture transfer within any range also described above. It is further noted that in some embodiments, an at least a portion of the rear surface of the sealing member material comprises an adhesive which is configured to adhere to the exterior surface of the packaging, and configured to adhere to the front surface of the sealing member material. In some embodiments the sealing member material is continuous and uninterrupted over the joint of the packaging. In certain embodiments, a pull tab is provided at an end of the sealing member that enables tearing the sealing member, and thus opening the packaging.

Example

The sealing member of FIGS. 8 and 9 was tested for moisture loss per day against two other common sealing members known in the art. First, three identical Kimwipes were placed into three identical containers, with one Kimwipe per container. Next, about 1.5 g of water was applied to each Kimwipe in each container. Each of the three containers were then sealed with one of the three sealing members. The sealed containers were placed in a controlled storage chamber with the temperature and humidity kept at 25° C.+2° C., and 60% RH+5% RH, respectfully. After allowing the containers to equilibrate within the storage chamber for about 48 hours, the weight of the containers were measured and recorded. The containers were then placed back in the storage chamber under the same conditions, and the weight remeasured every 2-3 days, repeating over a one month period of time. After calculating the daily water loss of each container based on the weight change of each container over time, the sealing member of the present disclosure had a moisture loss of 1.15 mg/day, and the two common sealing members known in the art had a moisture loss of 2.55 mg/day, and 2.46 mg/day.

The terms "about" or "substantially" as used herein can indicate that certain recited values or conditions are intended to be read as encompassing the expressly recited value or condition and also values that are relatively close thereto or conditions that are recognized as being relatively close thereto. For example, unless otherwise indicated herein, a value of "about" a certain number or "substantially" a certain value can indicate the specific number or value as well as numbers or values that vary therefrom (+ or −) 2% or less, or 1% or less. Similarly, unless otherwise indicated herein, a condition that substantially exists can indicate the condition is met exactly as described or claimed or is within typical manufacturing tolerances or would appear to meet the required condition upon casual observation even if not perfectly meeting the required condition. In some embodiments, the values or conditions may be defined as being express and, as such, the term "about" or "substantially" (and thus the noted variances) may be excluded from the express value. Where a plurality of possible lower end values and a plurality of possible upper end values are provided for a particular parameter, it is understood that all possible combinations of values inclusive of any of the lower end values and any of the upper end values are encompassed for describing the parameter. Unless otherwise stated, it is understood that a listing of alternative material for a defined use includes the option to expressly exclude any one or more of the listed alternatives in any combination.

Many modifications and other aspects of the disclosure set forth herein will come to mind to one skilled in the art to which the disclosure pertains having the benefit of the teachings presented in the foregoing descriptions and the associated drawings. Therefore, it is to be understood that the disclosure is not to be limited to the specific aspects disclosed and that modifications and other aspects are intended to be included within the scope of the appended claims. Although specific terms are employed herein, they are used in a generic and descriptive sense only and not for purposes of limitation.

That which is claimed:

1. A packaged product, comprising:

a container comprising a container body and a container cover arranged to engage the container body so as to define a joint extending around a periphery of the container;

a product positioned within the container, the product being a solid and having a defined moisture content; and a sealing member surrounding the periphery of the container in the location of the joint, the sealing member being a tearable tape that is at least partially adhered to both the container body and the container cover;

wherein the sealing member is effective to limit moisture transfer through the joint as measured by a change in the defined moisture content of the product positioned within the container of less than 2 mg/day;

wherein the sealing member extends from a first end to a second end, the first end defining a pull tab, and the sealing member has a front surface and a rear surface;

wherein the tearable tape is continuous and uninterrupted and excludes a pre-positioned line of weakness, wherein at least a portion of the first end of the sealing member overlaps at least a portion of the second end of the sealing member to define an interface, wherein the sealing member further comprises a tearing propagation line extending from a base of the pull tab into the interface, wherein the tearing propagation line extends about 15 mm or less from the base of the pull tab into the interface, and wherein the rear surface of the sealing member comprises an adhesive layer and at least a portion of the rear surface comprises a varnish material on top of the adhesive layer.

2. The packaged product of claim 1, wherein the sealing member has a sufficient length so that the first end overlaps the second end when surrounding the periphery of the container.

3. The packaged product of claim 1, wherein the first end to the second end is at least partially adhered to both the container body and the container cover.

4. The packaged product of claim 3, wherein at least a portion of the pull tab that is defined at the first end is not adhered to the second end segment.

5. The packaged product of claim 1, wherein the first end has a terminal edge, and wherein a portion of the pull tab extends a distance beyond the terminal edge.

6. The packaged product of claim 3, wherein at least a portion of the second end segment of the tearable tape is fixedly adhered to the container.

7. The packaged product of claim 6, wherein the tearable tape comprises a continuous adhesive coating.

8. The packaged product of claim 5, wherein the portion of the pull tab that extends a distance beyond the terminal edge has a curvilinear edge.

9. The packaged product of claim 1, wherein the change in the defined moisture content of the product positioned within the container is less than 1.5 mg/day.

* * * * *